US008944171B2

(12) United States Patent
Parrott et al.

(10) Patent No.: US 8,944,171 B2
(45) Date of Patent: Feb. 3, 2015

(54) METHOD AND APPARATUS FOR COMPLETING A MULTI-STAGE WELL

(75) Inventors: Robert A. Parrott, Sugar Land, TX (US); Bruno Lecerf, Novosibirsk (RU); Sergey Vladimirovich Solovyov, Tyumen (RU); Mikhail Petrovich Gusev, Novosibirsk (RU); Ilya Anatolievich Pavlov, Novosibirsk (RU); Jason Baihly, Katy, TX (US); Michael Bertoja, Bellaire, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 518 days.

(21) Appl. No.: 13/197,005

(22) Filed: Aug. 3, 2011

(65) Prior Publication Data

US 2013/0000926 A1 Jan. 3, 2013

Related U.S. Application Data

(60) Provisional application No. 61/502,613, filed on Jun. 29, 2011.

(51) Int. Cl.

| | |
|---|---|
| ***E21B 33/12*** | (2006.01) |
| ***E21B 43/26*** | (2006.01) |
| ***E21B 34/14*** | (2006.01) |

(52) U.S. Cl.

CPC ..... *E21B 43/26* (2013.01); *E21B 34/14* (2013.01)

USPC ..... 166/386

(58) Field of Classification Search

USPC ..... 166/332.1, 332.3, 332.4, 373, 381, 386

See application file for complete search history.

(56) References Cited

U.S. PATENT DOCUMENTS

| | | | |
|---|---|---|---|
| 3,011,548 | A | 12/1961 | Holt |
| 3,054,415 | A | 9/1962 | Baker et al. |
| 3,263,752 | A | 8/1966 | Conrad |
| 3,269,463 | A | 8/1966 | Page, Jr. |
| 3,995,692 | A | 12/1976 | Seitz |

(Continued)

FOREIGN PATENT DOCUMENTS

| | | | |
|---|---|---|---|
| WO | 03095794 | A1 | 11/2003 |
| WO | 2004088091 | A1 | 10/2004 |

OTHER PUBLICATIONS

Thomson, D. W., and Nazroo, M. F., Design and Installation of a Cost-Effective Completion System for Horizontal Chalk Wells Where Multiple Zones Require Acid Stimulation, SPE 51177 (a revision of SPE 39150), Offshore Technology Conference, May 1997, Houston, TX, USA.

(Continued)

*Primary Examiner* — David Bagnell
*Assistant Examiner* — Kristyn Hall
(74) *Attorney, Agent, or Firm* — Jeffery R. Peterson; Brandon S. Clark

(57) ABSTRACT

A technique includes deploying a string that includes a seat assembly in a well; and running a shifting tool in a passageway of the string. The shifting tool shifts the seat assembly to cause the seat assembly to transition between a first state in which the seat assembly forms a seat that is adapted to allow an untethered object communicated in the passageway of the string to pass through the seat assembly to a second state in which the seat assembly is adapted to catch the object to form a fluid barrier in the string. The fluid barrier is used to divert fluid in the tubing string to perform, for example, a stimulation operation.

25 Claims, 17 Drawing Sheets

(56) References Cited

U.S. PATENT DOCUMENTS

| | | | | |
|---|---|---|---|---|
| 4,064,937 | A | 12/1977 | Barrington | |
| 4,355,686 | A | 10/1982 | Arendt | |
| 4,729,432 | A | 3/1988 | Helms | |
| 4,771,831 | A | 9/1988 | Pringle et al. | |
| 4,893,678 | A * | 1/1990 | Stokley et al. | 166/374 |
| 5,183,114 | A | 2/1993 | Mashaw, Jr. et al. | |
| 5,224,044 | A | 6/1993 | Tamura et al. | |
| 5,295,393 | A | 3/1994 | Thiercelin | |
| 5,333,692 | A | 8/1994 | Baugh et al. | |
| 5,526,888 | A | 6/1996 | Gazewood | |
| 5,921,318 | A | 7/1999 | Ross | |
| 5,988,285 | A | 11/1999 | Tucker et al. | |
| 6,006,838 | A | 12/1999 | Whiteley et al. | |
| 6,059,032 | A | 5/2000 | Jones | |
| 6,155,342 | A | 12/2000 | Oneal et al. | |
| 6,206,095 | B1 | 3/2001 | Baugh | |
| 6,216,785 | B1 | 4/2001 | Achee, Jr. et al. | |
| 6,302,199 | B1 | 10/2001 | Hawkins et al. | |
| 6,334,486 | B1 | 1/2002 | Carmody et al. | |
| 6,371,208 | B1 | 4/2002 | Norman et al. | |
| 6,443,228 | B1 | 9/2002 | Aronstam et al. | |
| 6,543,538 | B2 | 4/2003 | Tolman et al. | |
| 6,634,429 | B2 | 10/2003 | Henderson et al. | |
| 6,907,936 | B2 | 6/2005 | Fehr et al. | |
| 6,997,263 | B2 | 2/2006 | Campbell et al. | |
| 7,066,265 | B2 | 6/2006 | Surjaatmadja | |
| 7,093,664 | B2 | 8/2006 | Todd et al. | |
| 7,108,067 | B2 | 9/2006 | Themig et al. | |
| 7,134,505 | B2 | 11/2006 | Fehr et al. | |
| 7,168,494 | B2 | 1/2007 | Starr et al. | |
| 7,210,533 | B2 | 5/2007 | Starr et al. | |
| 7,322,417 | B2 | 1/2008 | Rytlewski et al. | |
| 7,325,617 | B2 | 2/2008 | Murray | |
| 7,353,879 | B2 | 4/2008 | Todd et al. | |
| 7,377,321 | B2 | 5/2008 | Rytlewski | |
| 7,387,165 | B2 | 6/2008 | Lopez de Cardenas et al. | |
| 7,431,091 | B2 | 10/2008 | Themig et al. | |
| 7,464,764 | B2 | 12/2008 | Xu | |
| 7,490,669 | B2 | 2/2009 | Walker et al. | |
| 7,543,634 | B2 | 6/2009 | Fehr et al. | |
| 7,543,647 | B2 | 6/2009 | Walker | |
| 7,552,779 | B2 | 6/2009 | Murray | |
| 7,571,765 | B2 | 8/2009 | Themig | |
| 7,575,062 | B2 | 8/2009 | East, Jr. | |
| 7,661,481 | B2 | 2/2010 | Todd et al. | |
| 7,748,460 | B2 | 7/2010 | Themig et al. | |
| 7,832,472 | B2 | 11/2010 | Themig | |
| 7,891,774 | B2 | 2/2011 | Silverbrook | |
| 2003/0180094 | A1 | 9/2003 | Madison | |
| 2004/0118564 | A1 | 6/2004 | Themig et al. | |
| 2004/0262016 | A1 | 12/2004 | Farquhar | |
| 2006/0124310 | A1 | 6/2006 | Lopez de Cardenas et al. | |
| 2006/0207764 | A1 | 9/2006 | Rytlewski | |
| 2006/0243455 | A1 | 11/2006 | Telfer et al. | |
| 2007/0044958 | A1 | 3/2007 | Rytlewski et al. | |
| 2007/0107908 | A1 | 5/2007 | Vaidya et al. | |
| 2007/0181224 | A1 | 8/2007 | Marya et al. | |
| 2007/0272413 | A1 | 11/2007 | Rytlewski et al. | |
| 2007/0284097 | A1 | 12/2007 | Swor et al. | |
| 2008/0105438 | A1 | 5/2008 | Jordan et al. | |
| 2008/0210429 | A1 | 9/2008 | McMillin et al. | |
| 2010/0101803 | A1 | 4/2010 | Clayton et al. | |
| 2010/0108323 | A1 * | 5/2010 | Wilkin | 166/373 |
| 2010/0132954 | A1 | 6/2010 | Telfer | |
| 2010/0209288 | A1 | 8/2010 | Marya | |
| 2011/0056692 | A1 | 3/2011 | Lopez de Cardenas et al. | |
| 2011/0127047 | A1 | 6/2011 | Themig et al. | |
| 2011/0278010 | A1 | 11/2011 | Fehr et al. | |
| 2012/0085538 | A1 | 4/2012 | Guerrero et al. | |

OTHER PUBLICATIONS

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

* cited by examiner

METHOD AND APPARATUS FOR COMPLETING A MULTI-STAGE WELL

This application claims the benefit under 35 U.S.C. §119 (e) to U.S. Provisional Patent Application Ser. No. 61/502,613, entitled, "SYSTEM AND METHODS OF USE FOR ACTIVATING A CASING SEAT WITH A SHIFTING TOOL," which was filed on Jun. 29, 2011, and is hereby incorporated by reference in its entirety.

TECHNICAL FIELD

The disclosure generally relates to a method and apparatus for completing a multi-stage well.

BACKGROUND

For purposes of preparing a well for the production of oil or gas, at least one perforating gun may be run in the well via a deployment mechanism, such as a wireline or a coiled tubular string. The shaped charges of the perforating gun(s) are fired when the gun(s) are appropriately positioned to perforate a tubing of the well and form perforating tunnels into the surrounding formation. Additional operations may be performed in the well to increase the well's permeability, such as well stimulation operations, for example operations that involve hydraulic fracturing. All of these operations typically are multiple stage operations, which means that each operation typically involves isolating a particular zone, or stage, of the well, performing the operation and then proceeding to the next stage. Typically, a multiple stage operation involves several runs, or trips, into the well.

SUMMARY

In an embodiment of the invention, a technique includes deploying a string that includes a seat assembly in a well; and running a shifting tool in a passageway of the string. The shifting tool shifts the seat assembly to cause the seat assembly to transition between a first state in which the seat assembly forms a seat that is adapted to allow an untethered object communicated in the passageway of the string to pass through the seat assembly to a second state in which the seat assembly is adapted to catch the object to form a fluid barrier in the string. The fluid barrier is used to divert fluid in the string.

In another embodiment of the invention, a technique includes deploying a tubular string that includes seat assemblies in a well, where each of the seat assemblies has an object pass through state in which the seat assembly is adapted to allow an untethered object communicated through a passageway of the string to pass through the seat assembly and an object catching state in which the seat assembly is adapted to catch the object. When the tubular string is initially deployed in the well, all of the seat assemblies are configured to be in the object catching state. The technique includes deploying the untethered object in the tubular string to cause the object to land in a seat of one of the assemblies to create a fluid barrier in the tubular string. The technique further includes diverting fluid using the fluid tight barrier to perform a stimulation operation in the well; and running a shifting tool in the tubular string in the passageway of the string to shift the seat assembly having the seat in which the object has landed to cause the shifted seat assembly to release the object to allow the object to travel through the tubular string to land in a seat of another one of the seat assemblies. The fluid tight barrier may be formed in other stages of the well for simulation operations in these stages, in a similar manner.

In another embodiment of the invention, a system that is usable with a well includes a string and at least one seat assembly disposed in the string. The seat assembly is adapted to be shifted by a shifting tool that is deployed in the string to transition the seat assembly between a first state in which the seat assembly forms a seat that is adapted to allow an untethered object communicated in the passageway of the string to pass through the seat assembly to a second state in which the seat assembly is adapted to catch the object to form a fluid barrier in the string.

In another embodiment of the invention, a system that is usable with a well includes a tubular string and seat assemblies that are disposed in the string. Each of the seat assemblies is adapted to be shifted by a shifting tool that is run inside a passageway of the tubular string to transition the seat assembly between a pass through state in which the seat assembly is adapted to allow an object communicated through a passageway of the string to pass through the seat assembly and an object catching state in which the seat assembly is adapted to catch the object in a seat of the assembly to form a fluid barrier in the tubular string. All of the assemblies are configured to be in the object catching state when the tubular string is initially deployed in the well.

In yet another embodiment of the invention, an assembly that is usable with a well includes a tubular housing, a compressible element and an operator. The housing is adapted to form part of a tubular string that is installed in a well, and the compressible element is disposed in the housing and has a compressed state in which the element is adapted to form a seat to catch an object that is communicated to the apparatus via the tubular string and an uncompressed state in which the element is adapted to allow the object to pass through the apparatus. The operator includes a profile that is adapted to be engaged by a shifting tool that is run inside the tubular string to transition the compressible element between the compressed state and the uncompressed state.

Advantages and other features of the invention will become apparent from the following drawings, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in environments that are deviated or horizontal, such terms may refer to a left to right, right to left, or other relationship as appropriate.

In accordance with embodiments of the invention, systems and techniques are disclosed herein for purposes of performing stimulation operations (fracturing operations and acidizing operations, as examples) in multiple zones, or stages, of a well using object catching assemblies (called "seat assemblies" herein), which are run into the well as part of a tubular string. In general, each object catching assembly has one of two states: a first state (called the "object catching state" herein) in which the assembly forms a seat to catch an untethered object (an activation ball, dart or sphere, as non-limiting examples) that is communicated downhole through the tubular string; and a second state (called the "pass through state" herein) in which the assembly allows the object to pass through the assembly.

As disclosed herein, during a process to perform stimulation operations in multiple stages of a well, the seat assemblies may be independently and selectively transitioned between the object catching and pass through states using a shifting tool that is run downhole inside the tubular string. As a non-limiting example, as further disclosed herein, to perform a stimulation operation in a given stage, a shifting tool is first run into the tubular string to engage a seat assembly (assumed, for this example, to be initially in the pass through state) at the bottom end of the stage. The shifting tool is manipulated to physically engage and shift the seat assembly to transition the seat assembly from the pass through state to the object catching state. Therefore, an untethered object, such as an activation ball, may be deployed in the tubular string for purposes of causing the object to land in the seat assembly to form a fluid tight barrier, which prevents fluid from progressing there past and farther down the central passageway of the tubular string; and the fluid barrier may then be used to divert fluid (divert fluid into the surrounding formation, for example) as part of the stimulation operation for the stage.

Figure 1:
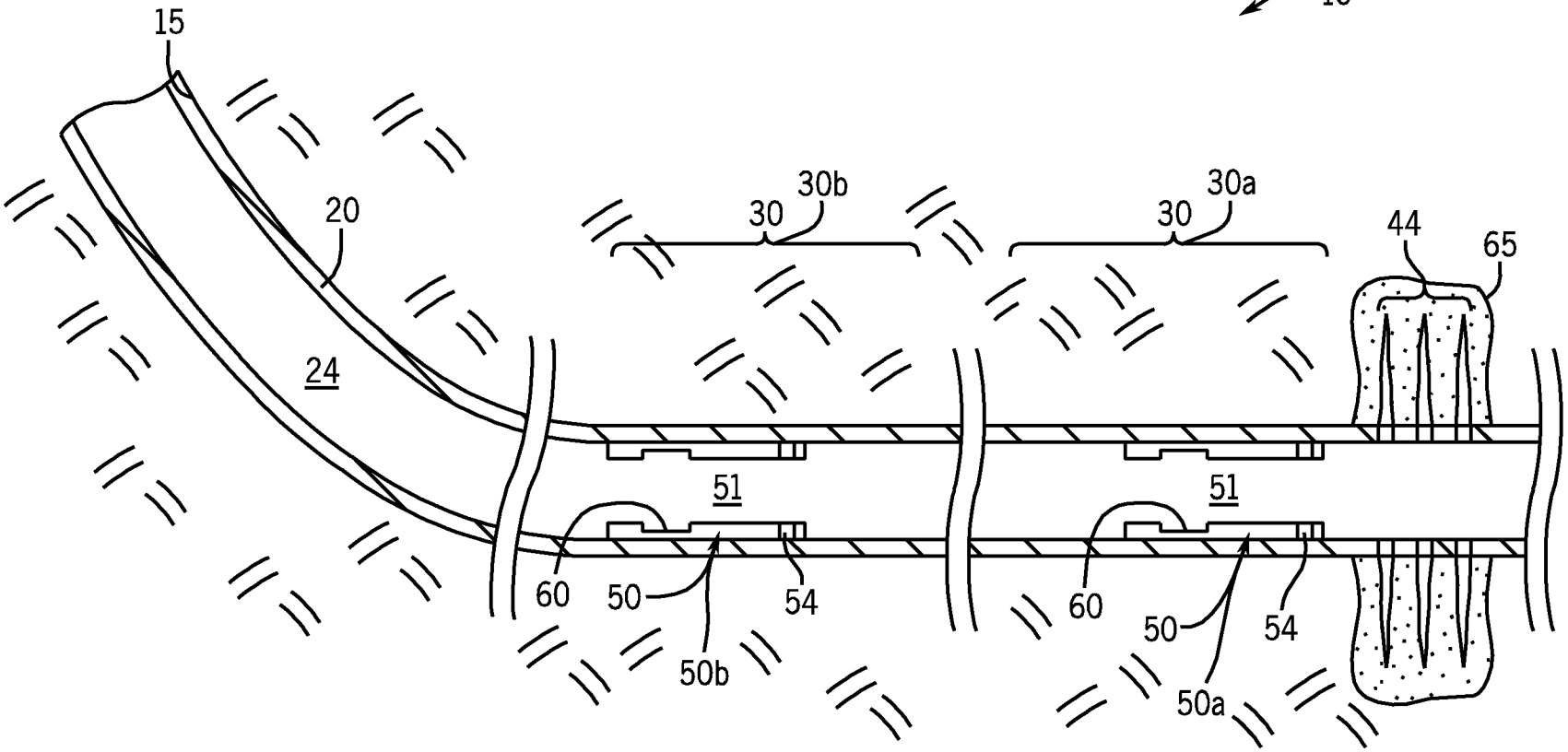
FIGS. 1, 2, 3, 4 and 5 are schematic diagrams of a well, which illustrate different phases of a multi-stage stimulation process using seat assemblies that are selectively transitioned between object catching states and pass through states using a shifting tool according to embodiments of the invention.
Figure 17:
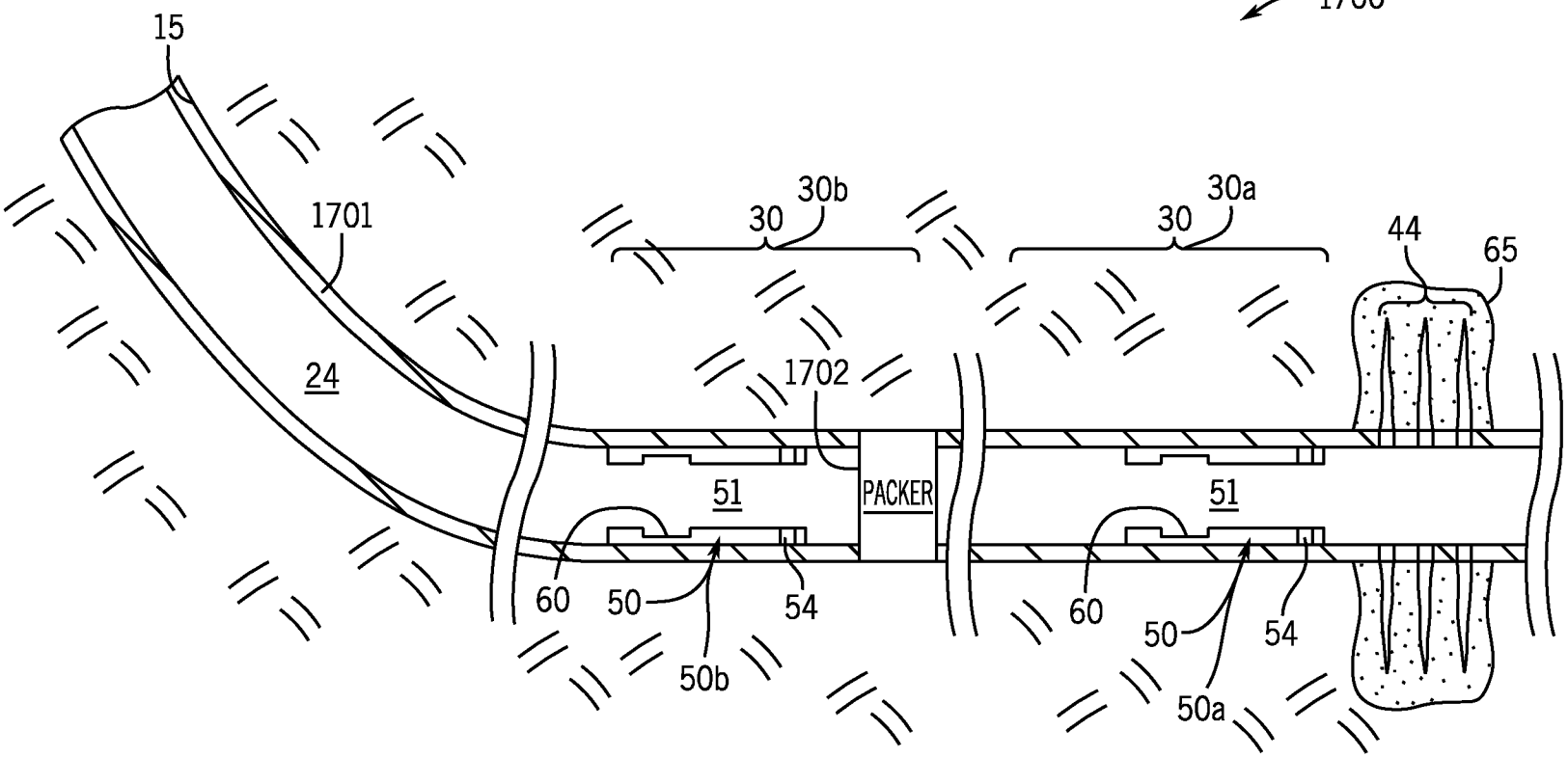
FIG. 17 is a schematic diagram of a well according to a further example implementation.

As a more specific example, FIG. 1 depicts a well 10 that includes a wellbore 15, which traverses one or more producing formations. As shown in FIG. 1, a tubular string 20 extends into the wellbore 15. In accordance with some embodiments of the invention, the tubular string 20 may be a casing string that extends along at least part of the wellbore 15 for lining and supporting the wellbore 15; and in general, the casing string may be cemented in place. In other embodiments of the invention, the tubular string 20 may extend into an open hole, which is uncased, such that one or more packers of the string 20 form one or more corresponding annular barriers between the string 20 and the wellbore wall. FIG. 17 depicts such a well 1700 having a tubular string 1701 (replacing the tubular string 20), which has a packer 1702. Moreover, although FIG. 1 and the subsequent figures depict a lateral wellbore 15, the techniques and systems that are disclosed herein may likewise be applied to vertical wellbores. Furthermore, in accordance with some embodiments of the invention, the well 10 may contain multiple wellbores, which contain strings that are similar to the tubular string 20.

In general, the wellbore 15 extends through one or multiple zones, or stages 30 (two exemplary stages 30*a* and 30*b* being depicted in FIG. 1, as non-limiting examples), of the well 10. For purposes of performing multi-stage stimulation operations (acidizing operations and hydraulic fracturing operations, for example) in the well 10, the tubular string 20 includes object catching seat assemblies 50 (herein called "seat assemblies 50"), which are spatially distributed along the tubular string 20 to coincide with the stages 30. As depicted in FIG. 1, each seat assembly 50 is concentric with the tubular string 20, forms a section of the tubular string 20 and in general, has a central passageway 51 that forms part of an overall central passageway 24 of the tubular string 20.

One seat assembly 50 is depicted for each stage 30 in FIG. 1. However, it is understood that a given stage 30 may include multiple seat assemblies 50, in accordance with other implementations. In addition, although only two seat assemblies 50 are depicted in FIG. 1, forty or fifty such seat assemblies 50, and in fact, an unlimited number of the seat assemblies 50 are contemplated in order to effect stimulation operations in a correspondingly unlimited number of stages or zones in the wellbore formation. Furthermore, for the examples that are disclosed herein, string 20 and the surrounding formation below the seat assembly 50*a* may be perforated, resulting in a corresponding set 44 of perforation tunnels, and stimulated resulting in stimulated region 65 by seat assemblies 50 not shown in FIG. 1.

Figure 3:
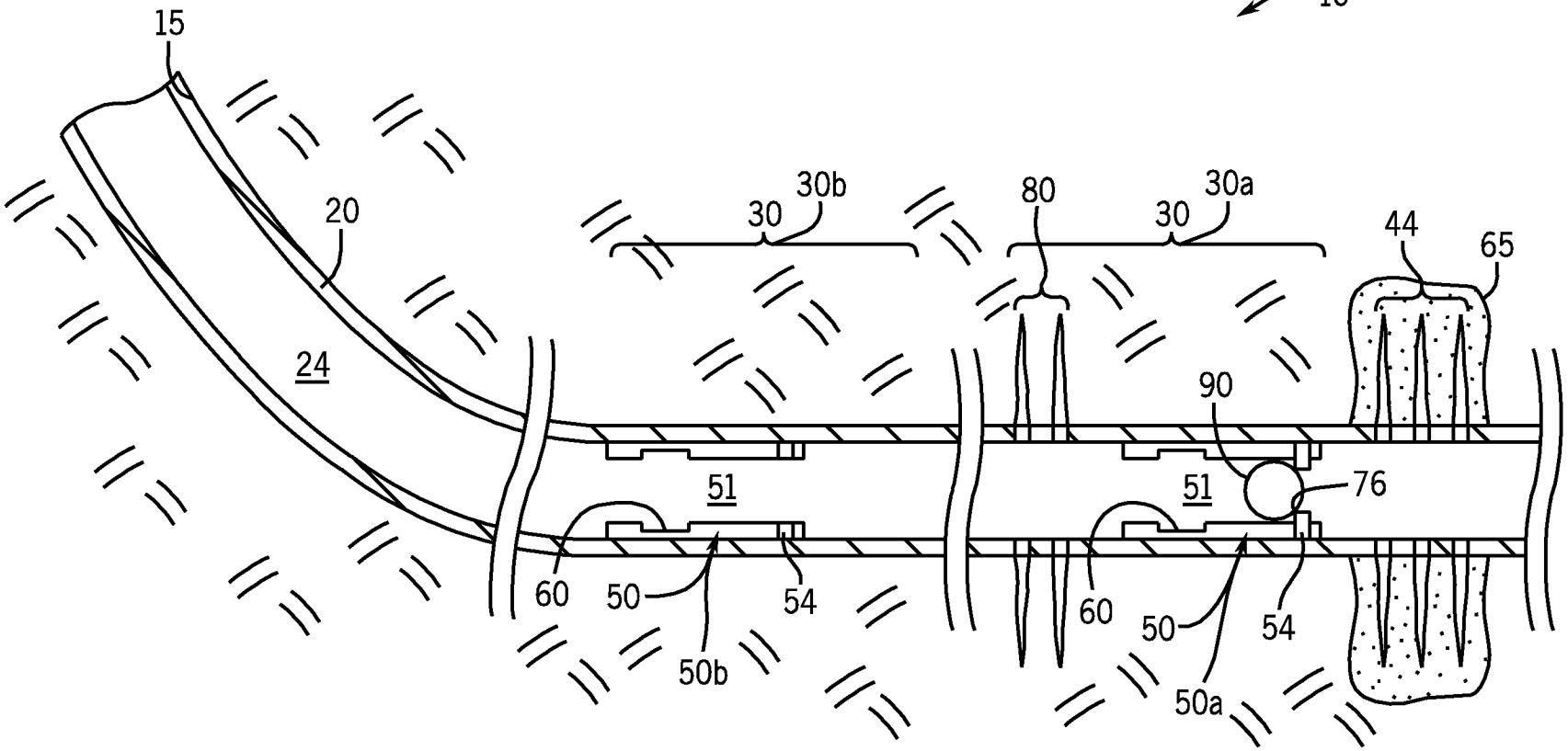
Figure 8:
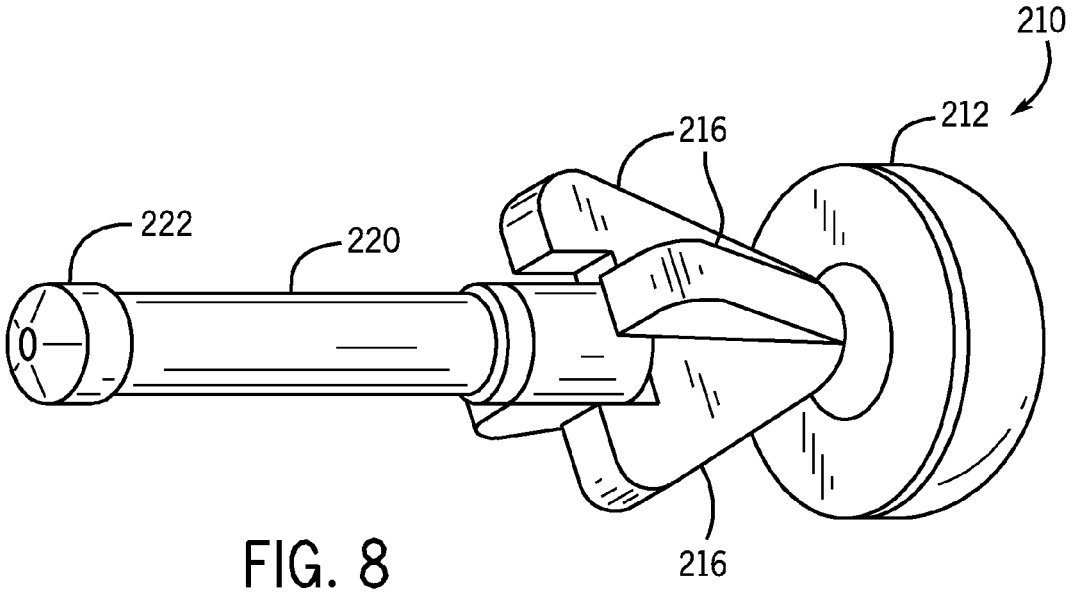
FIG. 8 is a perspective view of the fishable dart depicted in FIGS. 7 and 9 according to embodiments of the invention.

In accordance with some embodiments of the invention, when initially deployed as part of the tubular string 20, all of the seat assemblies 50 are in their run-in-hole, pass through state, which allows an untethered, dropped object (a spherical object, such as activation ball 90 that is depicted in FIG. 3, or a dart, such as dart 210 that is depicted in FIG. 8, as non-limiting examples) traveling through the tubular string 20 to pass through their central passageways 51. As disclosed herein, a given seat assembly 50 may subsequently be placed in an object catching state, a state in which the assembly 50 is configured to catch such an object. More specifically, in its object catching state, the seat assembly 50 restricts the passageway 51 to form a seat 76 (see FIG. 3, for example) that is sized to catch the object and thus, not allow the object to pass through the assembly 50.

Still referring to FIG. 1, more specifically, a given seat assembly 50 may be targeted as it may be desired to use the targeted assembly 50 for purposes of performing a stimulation operation in a given stage 30. In this manner, the seat assembly 50 that is targeted may be transitioned from the pass through state to the object catching state so that an object that is deployed (dropped, for example) through the central passageway 24 (from the surface of the well 10 or from another downhole tool) may travel to the assembly 50 and become lodged in the assembly's object catching seat to create a fluid tight barrier. The fluid tight barrier may be used, as further described herein, for purposes of diverting fluid uphole of the lodged object (diverting a treatment fluid into a surrounding formation, for example) to perform a stimulation operation in the stage 30.

Turning now to the more specific details, in general, each seat assembly 50 includes a seat forming element 54, which is constructed to be radially retracted to place the assembly 50 in the object catching state. As further described herein, in accordance with some embodiments of the invention, the seat forming element 54 may be an element, such as a C-ring, that in its uncompressed state, allows the object pass through the C-ring but in its compressed state, forms an O-ring shape for purposes of catching the object. The seat forming element 54 may be formed from one of a number of different compressible elements (a collet as another example), in accordance with the many possible embodiments of the invention.

In accordance with embodiments of the invention, for purposes of transitioning the seat assembly 50 between its pass through and object catching states, a shifting tool (not shown in FIG. 1) is run downhole through the central passageway 24 of the tubular string 20. The shifting tool contains an outer surface profile (an outer surface profile of a collet, for example) that engages a matching inner surface profile 60 of the targeted seat assembly 50. The engagement of the shifting tool with the profile 60 allows the shifting tool to be longitudinally translated (uphole or downhole, depending on the particular implementation) along the wellbore 15 for purposes of shifting an operator (not depicted in FIG. 1) of the seat assembly 50 to cause the assembly 50 to transition from the pass through state to the object catching state. Likewise, the shifting tool may be translated in the opposite direction (while engaged with the profile 60) for purposes of transitioning the seat assembly 50 from the object catching state to the pass through state. As another variation, the seat assembly 50 may contain a first profile that is engaged by a shifting tool for transitioning the assembly 50 to the object catching state and another profile that is engaged by a shifting tool for transitioning the assembly 50 to the pass through state.

As described further herein, in accordance with some embodiments of the invention, shifting tools may be run downhole at different times inside the tubular string 20 for purposes of selectively and independently transitioning the seat assemblies 50 between their object catching and pass through states. Moreover, as disclosed herein, the particular shifting tool that is used may be part of a dedicated shifting tool assembly or a shifting tool, which is part of an assembly (such as a perforating gun, for example) that also performs another downhole function. A given shifting tool may be conveyed downhole via a conveyance line, such as a slickline, wireline, coiled tubular string, etc., depending on the particular implementation.

For the first example of a multi-stage stimulation process described below, it is assumed that the tubular string 20 is deployed, or installed, in the wellbore 15 with all of the seat assemblies 50 being initially placed in pass through states; and it is further assumed that the stimulation operations are performed in a direction from the toe end to the heel end of the wellbore 15. Thus, in FIG. 1, seat assemblies 50*a* and 50*b* are in their initial, pass through states. However, in accordance with other examples also described herein in connection with FIGS. 11-14, the seat assemblies 50 may be initially deployed with the tubular string 20 such that all of the assemblies 50 are configured to be in their object catching states; and for these examples, the stimulation operations progress from the heel end toward the toe end of the wellbore 15.

Figure 2:
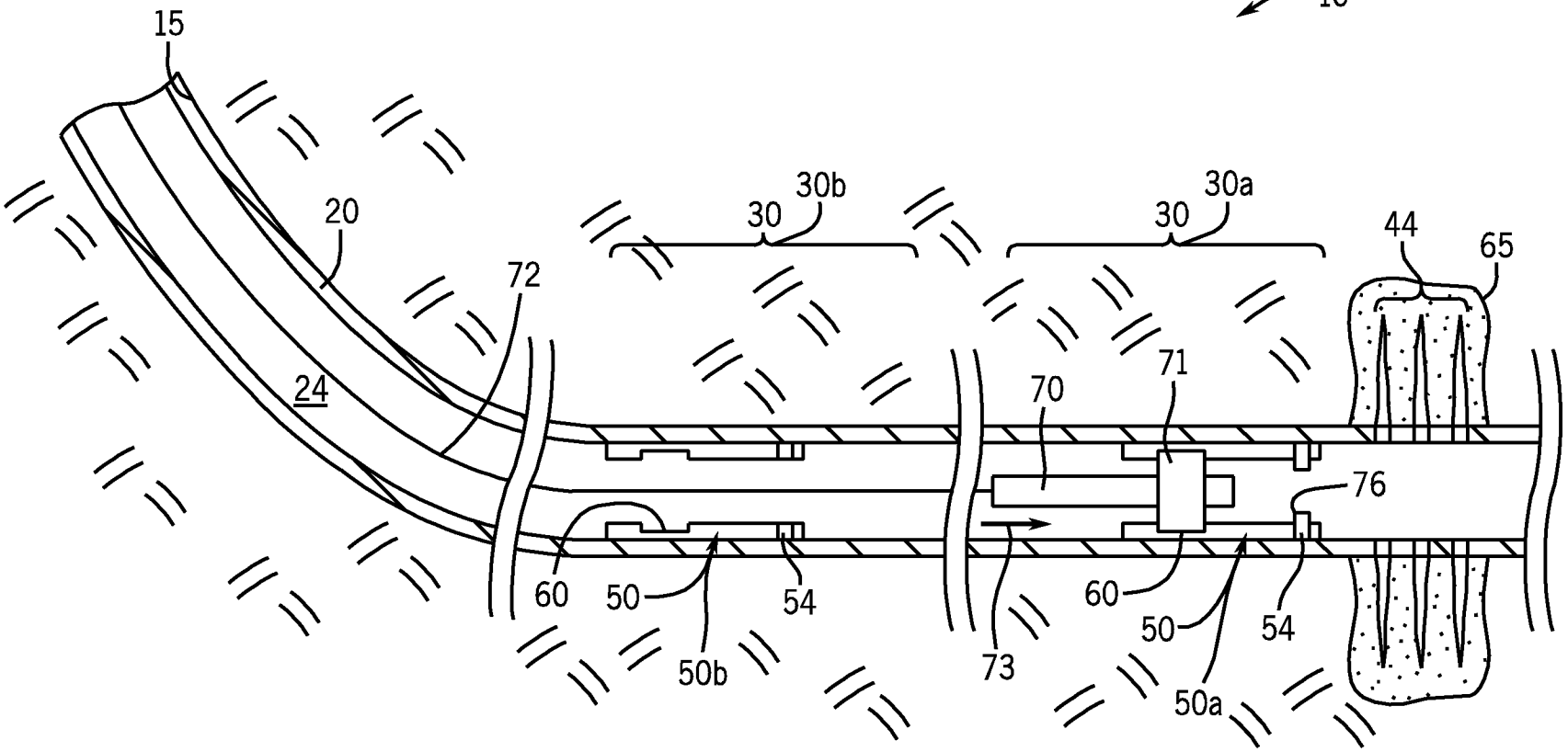

Referring to FIG. 2, the lowermost seat assembly 50*a* depicted in FIG. 2 may first be transitioned from the pass through state to the object catching state by running a shifting tool 71 downhole to engage the inner surface profile 60 of the assembly 50*a*. For this non-limiting example, the shifting tool 71 is part of a perforating gun 70, which may be run downhole via a conveyance line, such as a wireline 72 or other conveyance line (coiled tubular, slickline, etc), depending on the particular implementation. As depicted in FIG. 2, the shifting tool 71 engages the profile 60 of the seat assembly 50*a*. In this manner, as a non-limited example, when an operator at the surface of the well 10 determines that the shifting tool 71 has passed through the seat assembly 50*b* and is in proximity to the seat assembly 50*a*, the operator may activate an engagement feature (allow a collet to expand, for example) of the shifting tool 71 so that this engagement feature may be used to physically engage the profile 60 and shift the assembly 50*a* (for example, a collet of the shifting tool 71 may contain a specific outer profile that matches the profile 60 so that the collet snaps into the profile 60).

As depicted by the arrow 73, once engaged with the profile 60, the weight of the perforating gun 70 may be used to shift the profile 60 in a downhole direction to place the seat assembly 50*a* in the object catching state, a state in which the seat forming element 54 radially contracts to form an object catching seat 76. It is noted that in accordance with other implementations, the shifting tool 71 may be pulled uphole to shift the profile 60 uphole for purposes of placing the seat assembly 50*a* in its object catching state. Regardless of how the state of the seat assembly 50 is transitioned, the object catching seat 76 is sized appropriately to catch an object that is communicated downhole through the central passageway 24 of the tubular string 20 and create a sufficient fluid seal to form a fluid tight barrier for purposes of diverting fluid above the lodged object in connection with a stimulation operation for the stage 30*a*.

Referring to FIG. 3, before the object is communicated downhole, however, the shifting tool 70 is manipulated by the surface operator to cause the tool 70 to become released from the profile 60; and thereafter, the perforating gun 70 is repositioned uphole from the seat assembly 50*a*, and perforating charges of the gun 70 are fired to perforate the tubular string 20 at least at one other location to create at least one set 80 of perforation tunnels. In this regard, the tubular string 20 and the surrounding formation are selectively perforated between the seat assembly 50*a* and the next seat assembly 50*b* to establish hydraulic communication between the central passageway 24 of the tubular string 20 and the surrounding formation within the stage 30*a*. Depending on the particular embodiment of the invention, all of the perforating in the stage 30*a* may be performed by a single perforating gun or by multiple perforating guns. Alternatively, in other embodiments of the invention, the perforating gun(s) may be replaced by a tool that is run downhole (on a coiled tubular string, for example) inside the central passageway 24 to deliver an abrasive slurry to form openings in the wall of the tubular string 20 and open fluid communication paths to the formation, which are similar to the perforation tunnels 80. This tool may contain a shifting tool, which is used to transition the seat assembly 50*a* between its object catching and pass through states, in accordance with some embodiments of the invention.

After the additional perforating operation(s) are completed, the perforating gun(s) are retrieved from the well 10 to create a free passage inside the tubular string 20 to deploy an untethered object. For the example that is depicted in FIG. 3, an exemplary activation ball 90 lodges in the seat 76 that is formed by the seat assembly 50*a*.

The activation ball 90 may be communicated downhole from the Earth surface or may be released, for example, from a downhole tool or from another seat assembly 50 that is disposed uphole with respect to the seat assembly 50*a*. The activation ball 90 travels through the central passageway 24 of the tubular string 20, and depending on the particular embodiment, the activation ball 90 may be pumped downhole or may free fall through the central passageway 24. On its journey to the seat assembly 50*a*, the ball 90 may pass through one or more seat assemblies 50 (such as the seat assembly 50*b* depicted in FIG. 3), which are located uphole of the seat assembly 50*a*, as these other seat assemblies 50 are in their initial, pass through states. Due to the landing of the object 90 in the seat 76, a fluid tight barrier is created in the casing string 24 at the seat assembly 50*a*.

Therefore, fluid may be communicated into the central passageway 24 of the tubular string 20 to perform a stimulation operation, which takes advantage of the fluid diversion that is provided by the fluid tight barrier that is created by the object 90 landing in the seat 76. As a non-limiting example, this stimulation operation may involve delivering fluid in a hydraulic fracturing operation to create various fractured regions, such as an exemplary fractured region 92 that is located uphole of the lodged ball 90, as is depicted in FIG. 4.

The activation ball 90 and/or the seat assembly 50 may be constructed to form a pressure relief mechanism to maintain pressure in the stage 30 below a given pressure threshold, in accordance with some embodiments of the invention. For example, in some embodiments of the invention, the activation ball 90 may be formed from a material that allows the ball 30 to deform, or otherwise fail, when the fluid pressure in the stage exceeds a predetermined pressure threshold, so that the deformed ball passes through the seat 96 to remove the fluid tight barrier. As another example, in other embodiments of the invention, the seat forming element 54 is constructed to sufficiently deform to an extent above a certain pressure threshold, which allows the activation ball 90 to pass through the seat 96 to remove the fluid tight barrier. As yet another example, in other embodiments of the invention, the seat forming element 54 and the ball 90 each deform to an extent above a certain pressure threshold to cooperate in a manner that allows the ball 90 to pass through the seat 96 to remove the fluid tight barrier. Thus, many variations are contemplated and are within the scope of the appended claims.

Figure 4:
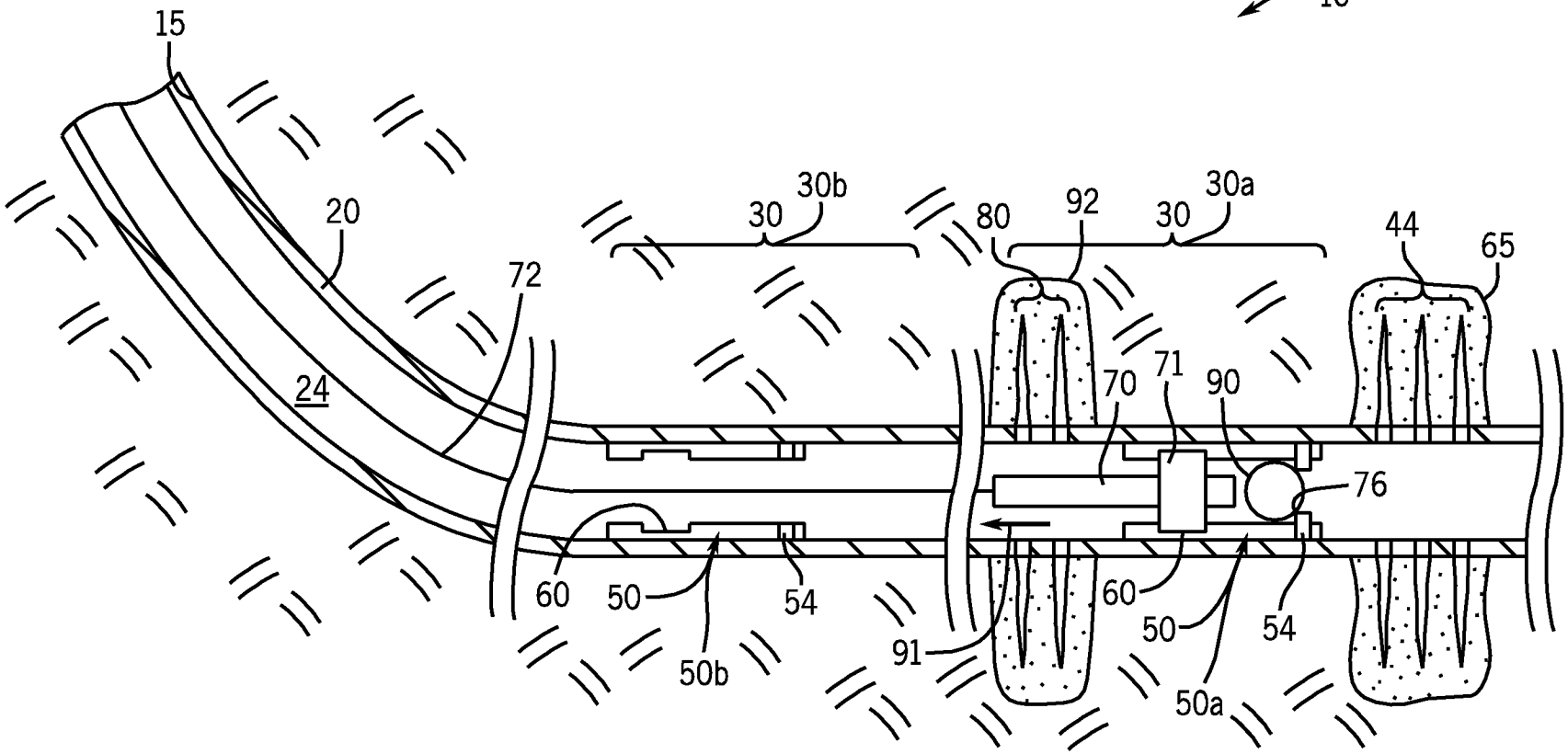
Figure 5:
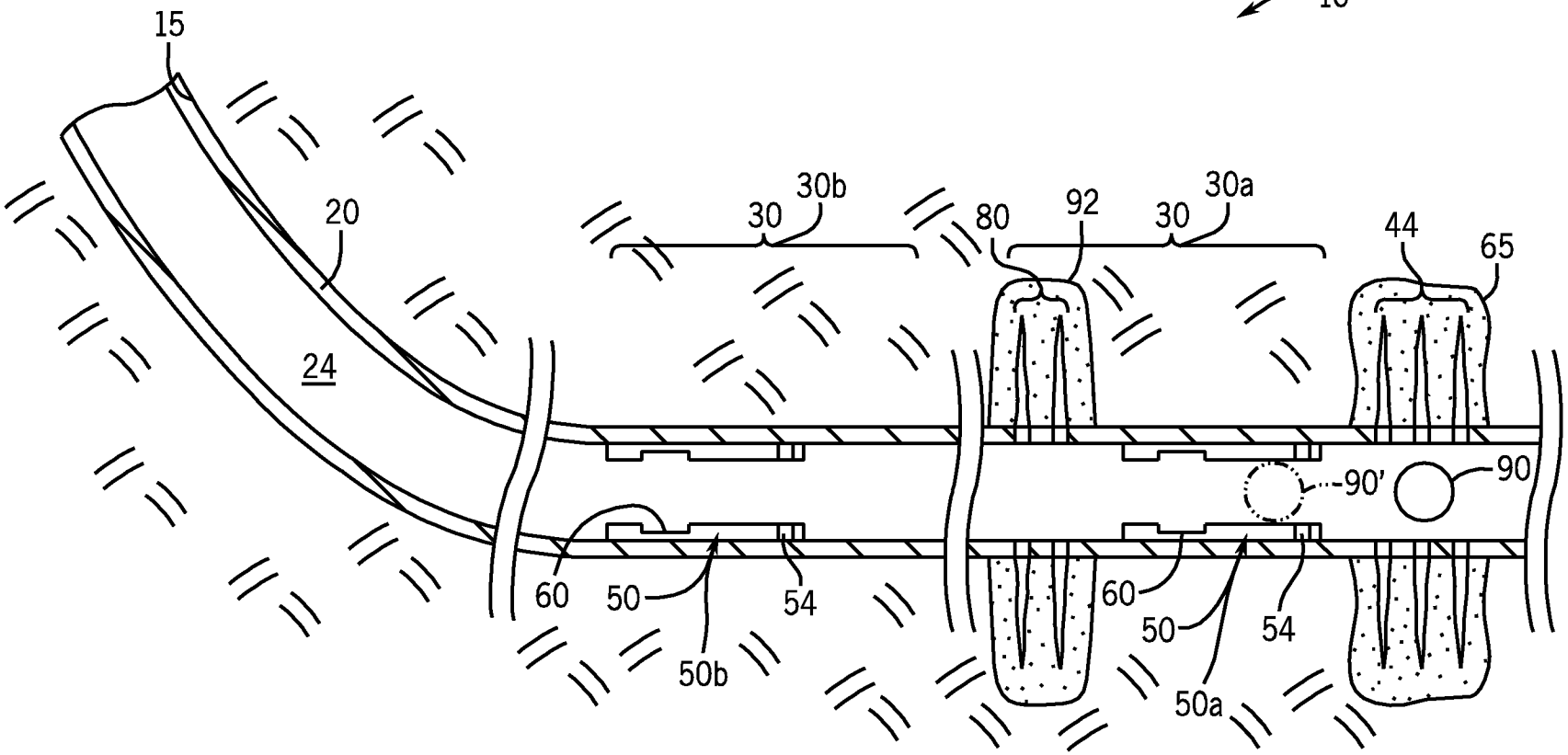

FIG. 4 also depicts the subsequent running of the shifting tool 71 back into tubular string 20 to deactivate the seat assembly 50*a* (i.e., transition the seat assembly 50*a* from the object catching state to the pass through state). In this manner, the shifting tool 71 engages the profile 60 and for this example, is shifted uphole (as indicated by arrow 91) to translate the profile 60 uphole to cause the seat assembly 50*a* to retract the seat forming element 54 to thereby release the activation ball 90, as depicted by reference numerals 90 and 90' in FIG. 5.

In accordance with other embodiments of the invention, the seat assembly 50*a* is not engaged with a shifting tool for purposes of releasing the activation ball 90. In this regard, depending on the particular implementation, the activation ball 90 may permanently remain in the seat 76; may be removed by a milling operation; or may remain in the seat 76 and be left to degrade to the point that the ball 90 falls out of the seat 76. For this latter example, the activation ball 90 may be made from a degradable material, such as an aluminum or aluminum alloy, which degrades in a relatively short period of time (degrades in a few days or within a week, as non-limiting exemplary ranges), due to contact of the material with one or more fluids that are present in the well environment or one or more fluids (acid, for example), which may be introduced into the well 10 for the specific purpose of dissolving the ball 90. As further described herein, the object may also be removed from the seat 76 using a fishing operation. As another example, the object may return to the surface along with production fluid from the well. Therefore, many variations are contemplated and are within the scope of the appended claims.

Thus, FIGS. 1-5 describe at least one way in which the seat assembly 50 may be selectively placed in an object catching state by a shifting tool and used to perform a stimulation operation in a given stage of a well. The technique may be repeated for purposes of performing stimulation operations in other stages of the well 10.

Figure 6:
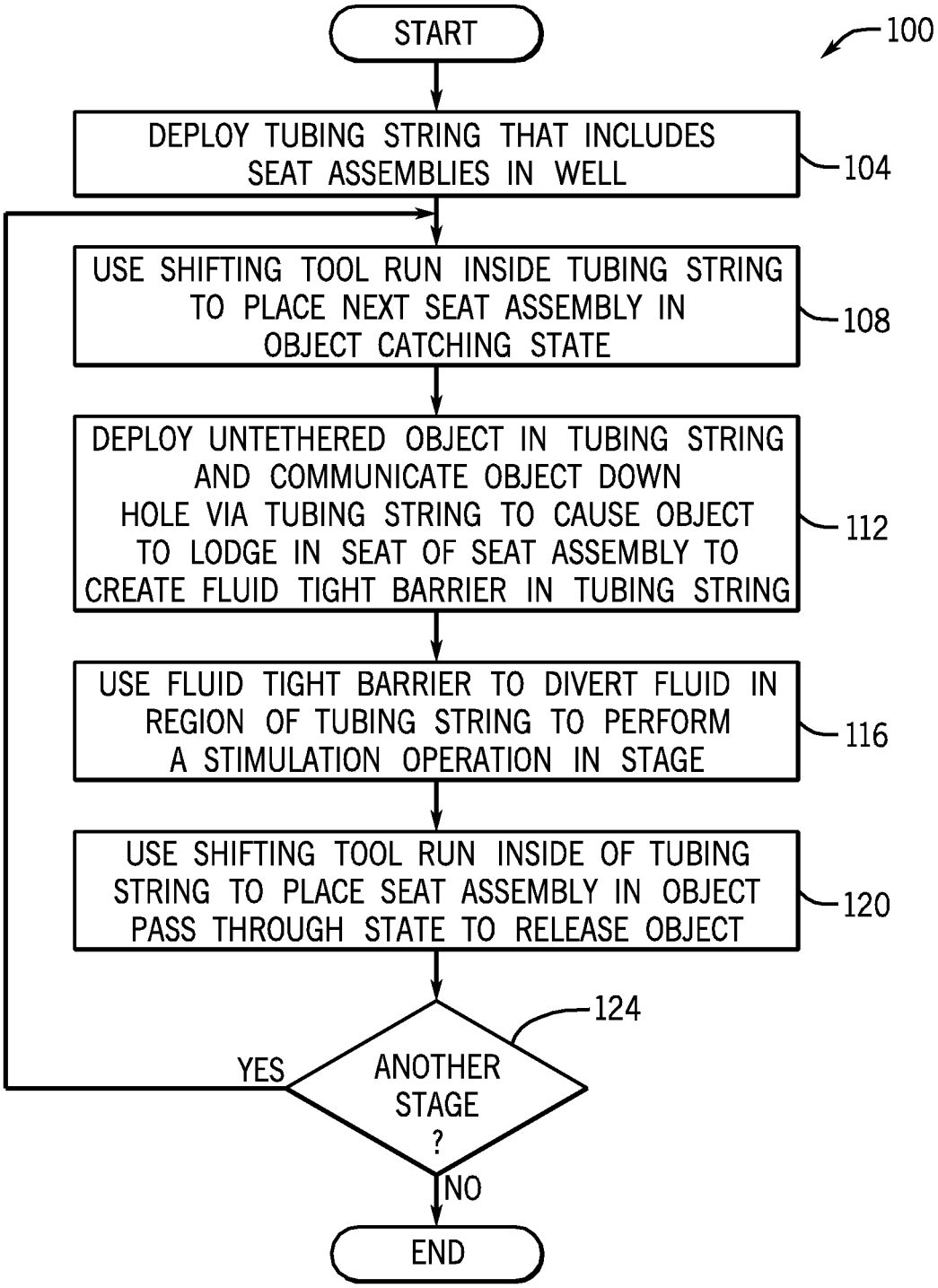
FIG. 6 is a flow diagram of the multi-stage stimulation process depicted generally in FIGS. 1-5 according to embodiments of the invention.

Referring to FIG. 6, therefore, in accordance with some embodiments of the invention, a technique 100 includes deploying (block 104) a tubular string that includes one or more seat assemblies in a well and using (block 108) a shifting tool that is run inside the tubular string to engage the next seat assembly 50 to place the seat assembly 50 in the object catching state. The technique 100 includes deploying (block 112) an untethered object, such as an activation ball (as a non-limiting example), in the tubular string and communicating the object downhole via the tubular string to cause the object to lodge in the seat assembly 50 to create a fluid tight barrier in the tubular string. This fluid tight barrier may then be used, pursuant to block 116, to divert fluid in a region for purposes of performing a stimulation operation in the stage. The technique 100 may also include using a shifting tool that is run inside the tubular string to place the seat assembly 50 in the pass through state to cause the assembly to release the object, pursuant to block 120, although the object may be left in the seat assembly 50 (to dissolve or remain in the seat, as examples), in accordance with other embodiments of the invention. As depicted in FIG. 6, if a determination is made (diamond 124) that a stimulation operation is to be performed in another stage, then control proceeds to block 108 to place the next seat assembly 50 in an object catching state.

Figure 7:
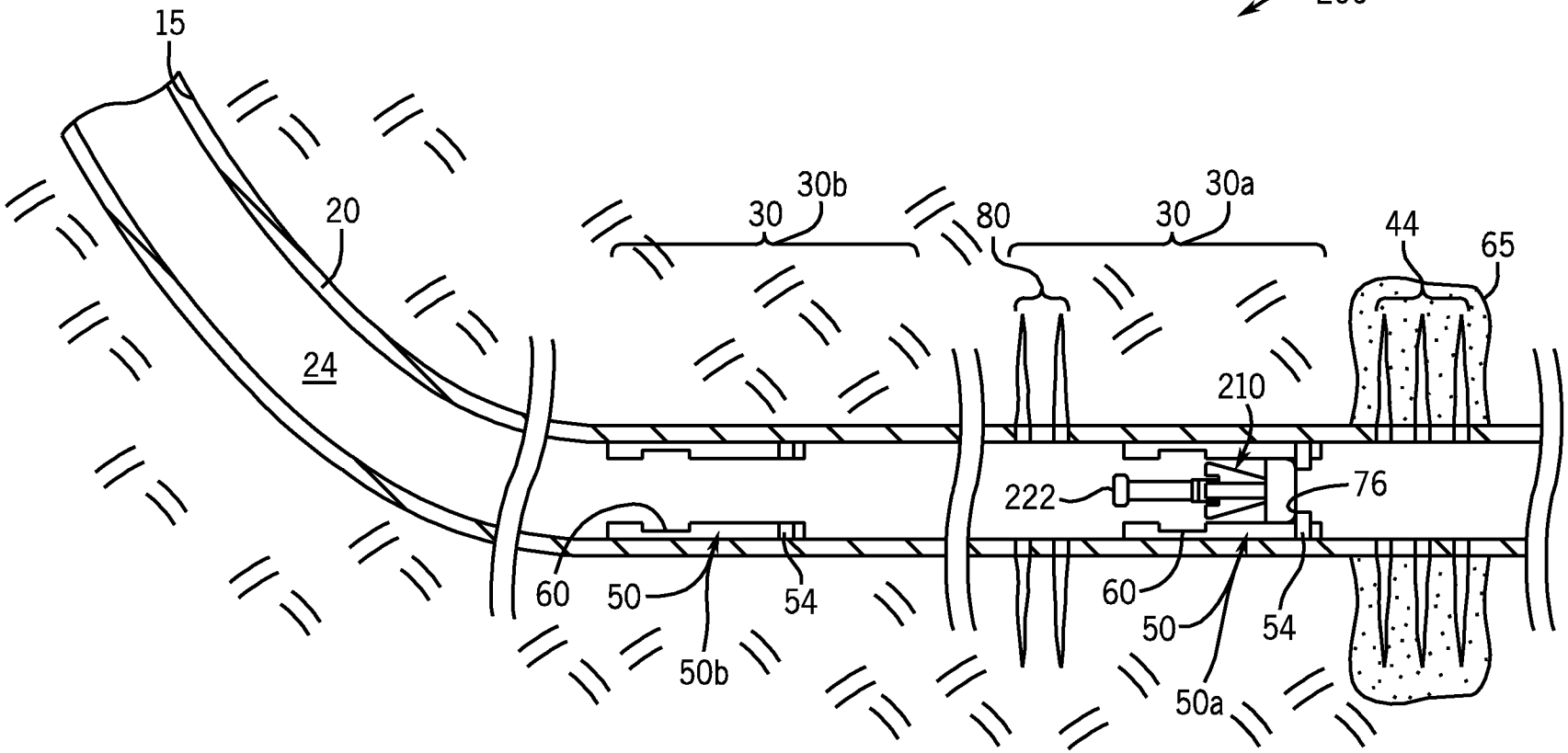
FIGS. 7 and 9 are schematic diagrams of a well, which illustrate the use of a fishable dart to form a fluid tight barrier in a tubular string to divert fluid according to embodiments of the invention.

Objects other than spheres, or balls, may be used as activation objects, in accordance with other embodiments of the invention. For example, FIG. 7 depicts a well 200 in which a fishable dart 210 is used as the activation object for a seat assembly 50*a* and is subsequently retrieved from the well 10. It is noted that in FIG. 7, similar reference numerals are used to denote similar elements that are discussed above. Referring to FIG. 8 in conjunction with FIG. 7, the dart 210 contains a plugging portion 212 that is constructed to land in the seat 76 to form a sufficient fluid seal to form the fluid tight barrier. The dart 210 may also include vanes, or fins 216, which radially extend from the plugging portion 212 for purposes of guiding the dart 210 downhole. The dart 210 further includes an elongated tail 220 that extends from the fins 216 and contains a fishing profile 222 for purposes of allowing the dart 210 to be retrieved from the well 200.

Figure 9:
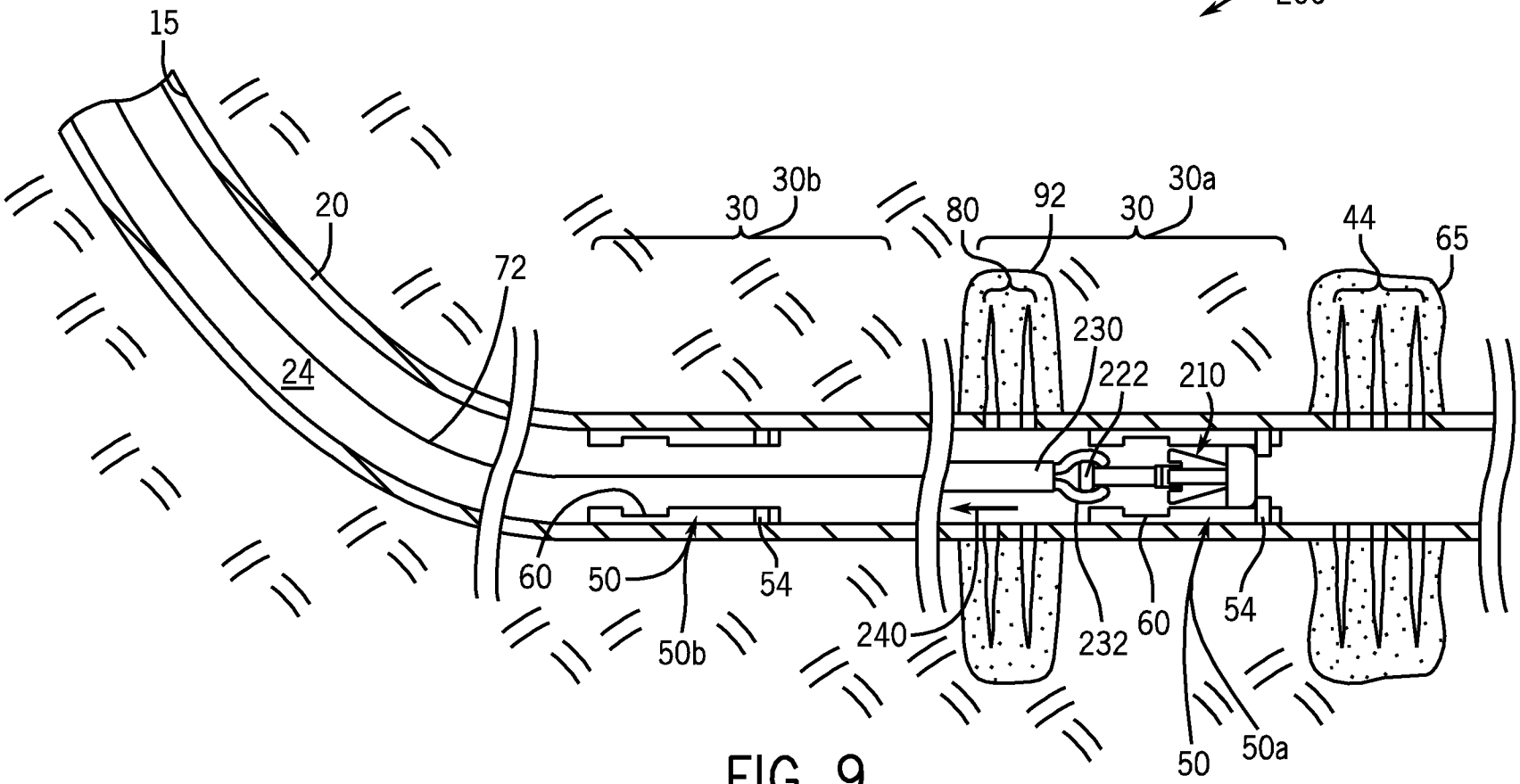

More specifically, referring to FIG. 9 in conjunction with FIG. 8, as a non-limiting example, a perforating gun 230 may be run downhole (on a wireline 72, for example) for purposes of retrieving the dart 210 after a given stimulation operation.

For this example, a fishing tool 232 is connected to the bottom end of the perforating gun 230. In general, the fishing tool 232, in accordance with some embodiments of the invention, may be a clamp that is constructed to latch onto the fishing profile 222 of the dart 210 such that after latching onto the profile 222, the fishing tool 232 (and perforating gun 230) may be retrieved in an uphole direction 240, as depicted in FIG. 9, for purposes of retrieving the dart 210 from the well 200.

Figure 10:
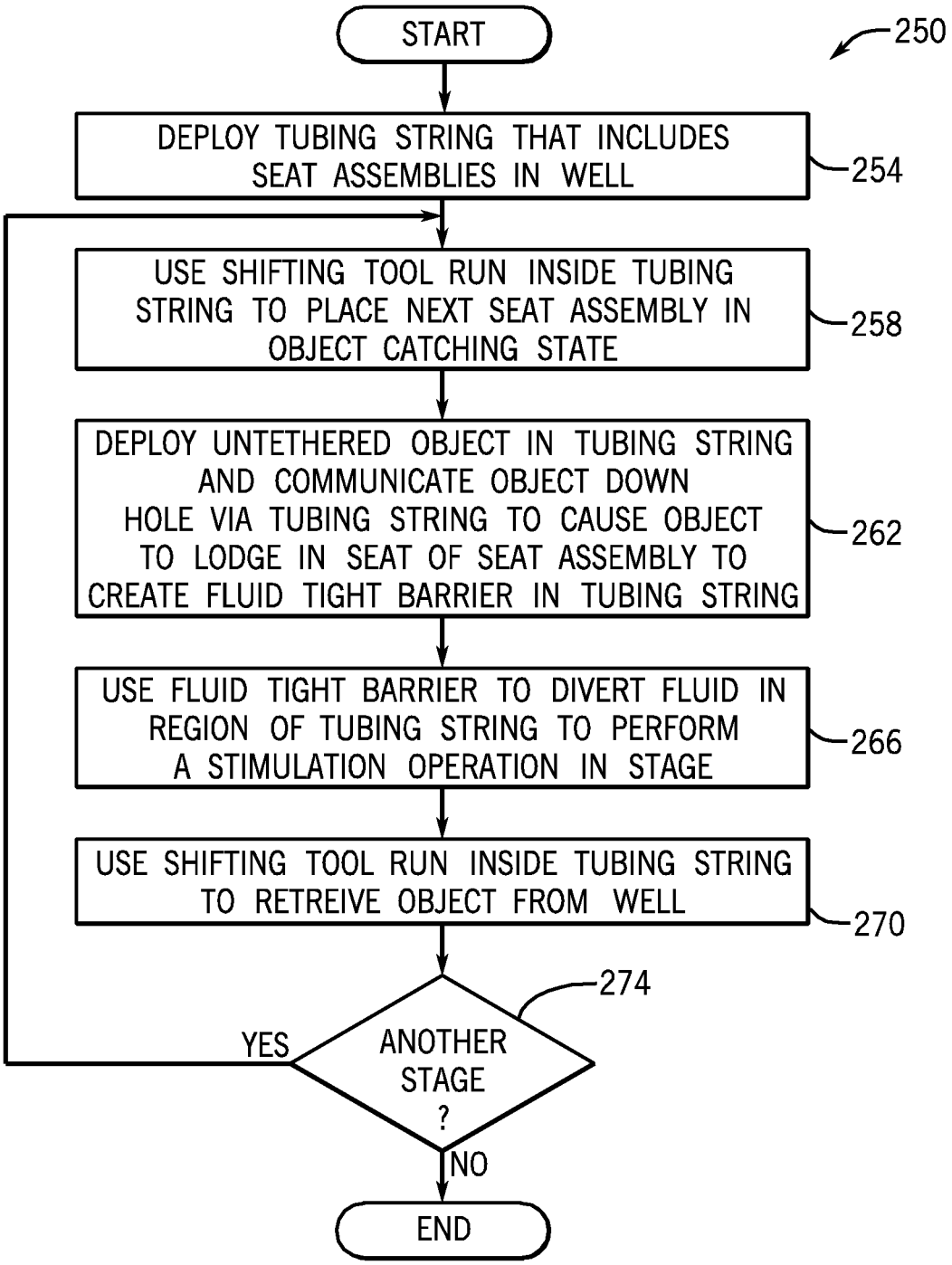
FIG. 10 is a flow diagram depicting a multi-stage stimulation process using a retrievable object according to embodiments of the invention.

Thus, referring to FIG. 10, a technique 250, in accordance with some embodiments of the invention, includes deploying a tubular string that includes one or more seat assemblies in a well, pursuant to block 254, and using a shifting tool that is run inside of the tubular string to place the next seat assembly 50 in the object catching state, pursuant to block 258.

A fishable object may then be deployed in a tubular string and communicated downhole via the tubular string to cause the object to lodge in the seat to create a fluid tight barrier in the tubular string pursuant to block 262. The fluid tight barrier may then be used to divert fluid for purposes of performing a stimulation operation in a given stage of the well, pursuant to block 266. Pursuant to block 270 of the technique 250, a tool may subsequently be run in the tubular string to retrieve the object from the well. Subsequently, a determination is made (diamond 274) whether a stimulation operation is to be performed in another stage. If so, control returns to the block 258 in which a shifting tool is run inside the tubular string to place the next seat assembly 50 in the object catching state, pursuant to block 258.

Figure 11:
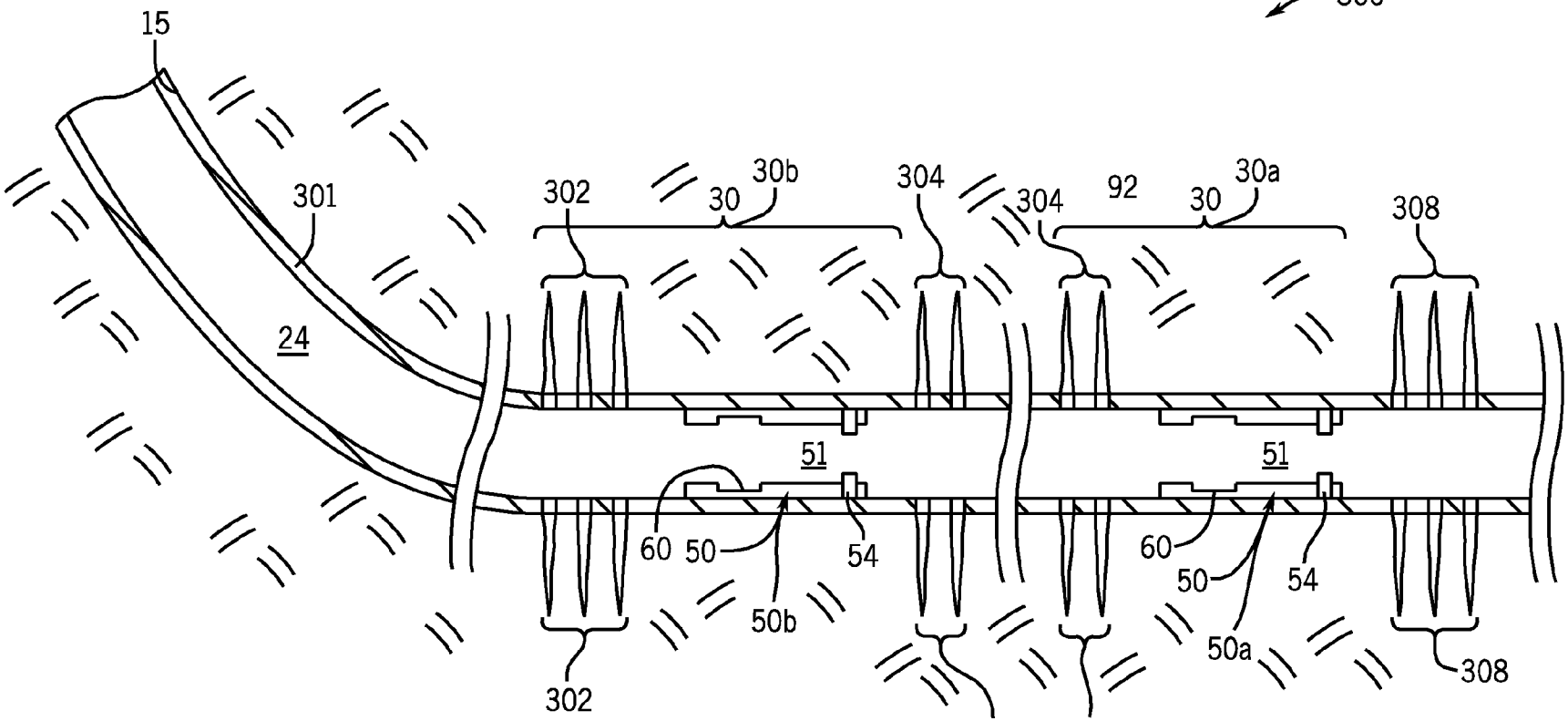
FIGS. 11, 12 and 13 are schematic diagrams of a well, which illustrate different phases of another multi-stage stimulation process using seat assemblies that are selectively transitioned between object catching states and pass through states using a shifting tool according to other embodiments of the invention.

FIG. 11 depicts a well 300 in accordance with other embodiments of the invention. In general, FIG. 11 contains the same reference numerals described above for purposes of denoting similar elements. However, unlike the wells disclosed above, the well 300 contains a tubular string 301, which has been installed in a wellbore 15 with seat assemblies 50 that are all initially configured to be in their object catching states.

For this example, the stimulation operations are performed from the heel to the toe ends of the wellbore 15, i.e., for this example, the stimulation operation is performed in stage 30*b* (using seat assembly 50*b*) before a stimulation operation is performed in stage 30*a* (using seat assembly 50*a*), and so forth. It is assumed for purposes of this example that perforating operations have already been performed in the well 300 to establish hydraulic communication with the surrounding formation in the various stages 30. Therefore, FIG. 11 depicts sets 302, 304, and 308 of perforation tunnels, which are representative of the results of these perforating operations. As another variation, the stages 30 may be perforated one at a time as the stimulation operations progress downhole such that each stage 30 may be perforated before the stimulation operation is performed in the stage 30, the next downhole stage 30 may then be perforated, and so forth. It is noted that for purposes of these operations, one or more tools (a perforating gun or an abrasive slurry-based tool, as examples) have been lowered downhole through the central passageway 24 of the tubular string 301 such that the tool(s) pass through the seat assemblies 50, even though the seat assemblies 50 are in their object catching states. As another variation, openings in the wall of the tubular string 20 to establish hydraulic communication with the surrounding formation(s) may be preformed in the string 20, and therefore, perforating operations may not be needed for these embodiments of the invention. In such embodiments, when a seat assembly 50 is in its object catching state, openings in the seat assembly 50 may be aligned with the preformed openings in the string 20, allowing fluid to be diverted by an objected landed in the seat assembly, through the seat and string openings and into the formation; and when a seat assembly 50 is in its object passing state, the seat assembly blocks adjacent preformed openings in the string 20, preventing fluid from entering the adjacent formation.

Figure 12:
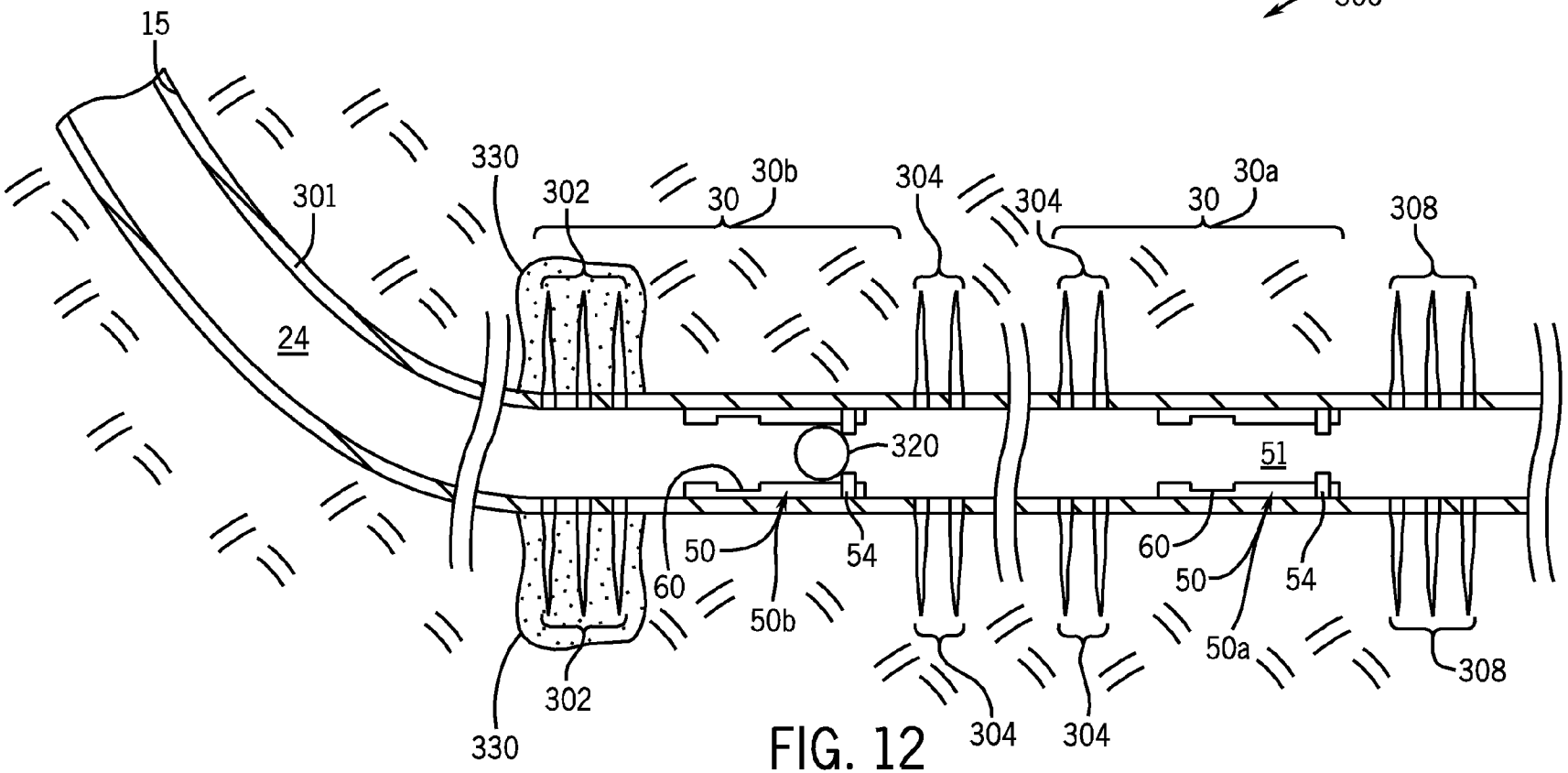

Referring to FIG. 12, thus, for this example, an untethered activation ball 320 may be deployed inside the central passageway 24 of the tubular string 301 and travel through the passageway 24 to land in the seat 76 of the seat assembly 50*b*, as depicted in FIG. 12. For this example, it is assumed that the seat assembly 50*b* is the first uphole assembly encountered by the activation ball 320, and the activation ball 320 may be deployed from the Earth surface. However, as further described below, if another seat assembly 50 is uphole from the seat assembly 50*b*, then the activation ball 320 may be deployed by releasing the ball 320 from this other seat assembly 50. As shown in FIG. 12, due to the fluid tight barrier created by the activation ball 320, a stimulation operation may be performed above the seat assembly 50*b* to create a corresponding fractured region 330 (assuming for this example that the stimulation operation is a fracturing operation).

Figure 13:
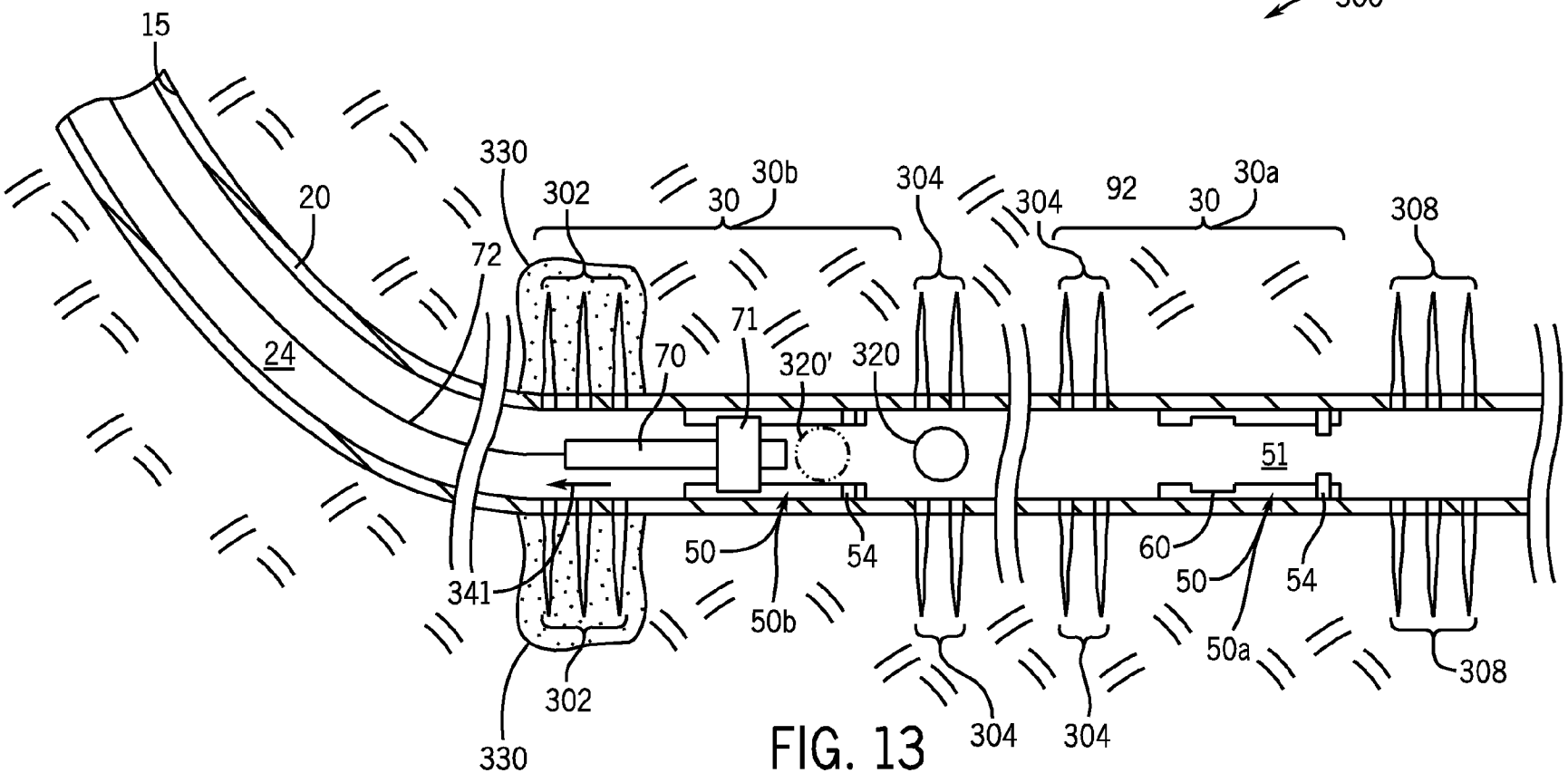

Referring to FIG. 13, the activation ball 320 may then be released from the seat assembly 50*b* (as depicted by reference numerals 320' and 320 in FIG. 13), which allows the ball 320 to travel farther downhole to lodge in the seat 76 of the next seat assembly 50*a*. For this purpose, FIG. 13 depicts the running of the perforating gun 70 with an attached shifting tool 71, which engages the profile 60 and may be shifted uphole (as indicated by the arrow 341), for example, for purposes of transitioning the seat assembly 50*b* from the object catching state to the pass through state.

At or near the end of the stimulation operation in the stage 30*b*, measures may be undertaken in the stage 30*b* to lower the injectivity of the stage 30*b*. For example, in accordance with some embodiments of the invention, flow inhibiting sealers, such as particulates, flakes, fibers, ball sealers and the like may be communicated into the stage 30*b* prior to the release of the activation ball 320 to lower the stage's injectivity.

Figure 14:
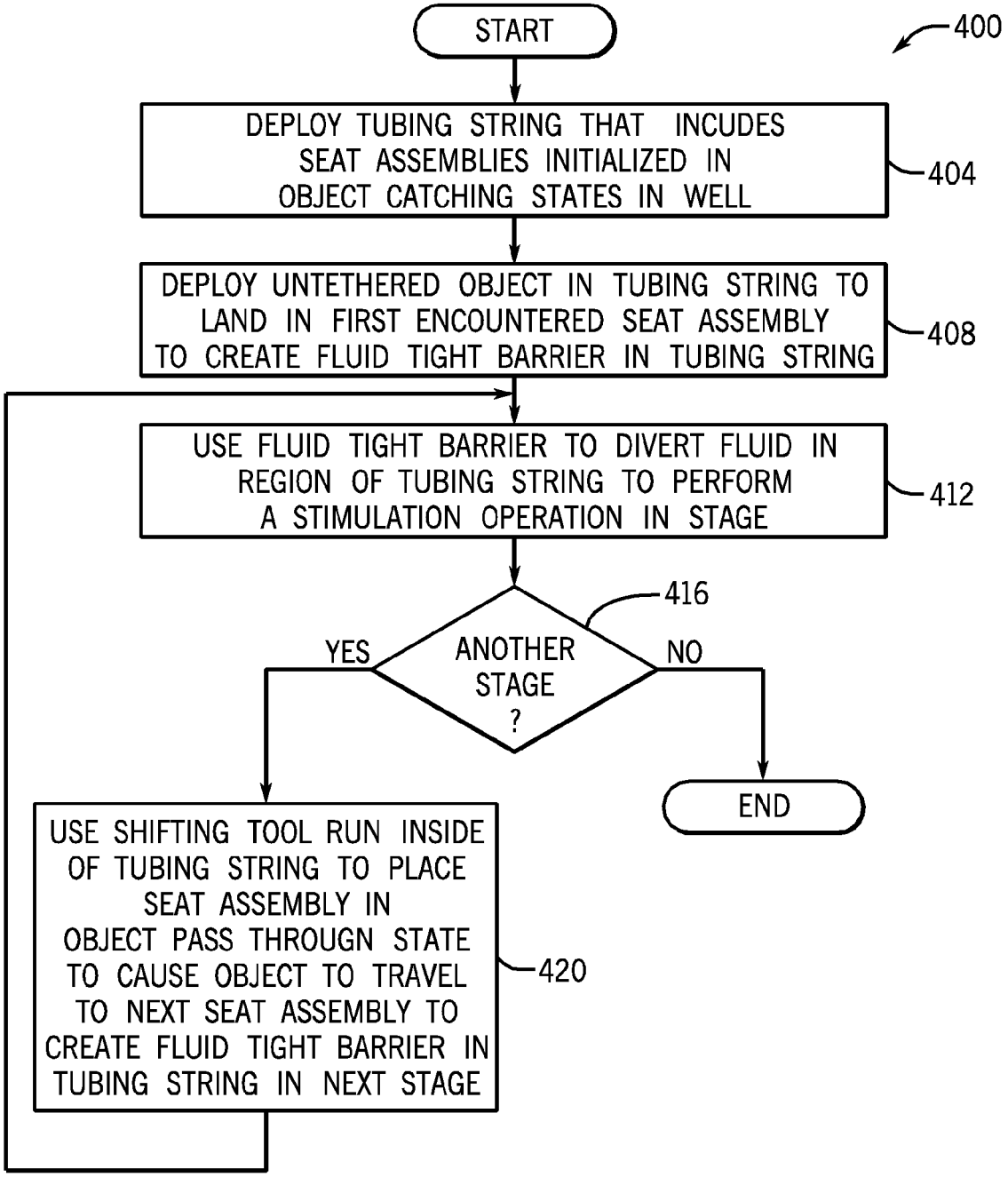
FIG. 14 is a flow diagram of the multi-stage completion process generally depicted in FIGS. 11-13 according to embodiments of the invention.

Referring to FIG. 14, thus, a technique 400 in accordance with some embodiments includes deploying (block 404) a tubular string that includes seat assemblies that are all initialized in object catching states in a well and deploying (block 408) an object in the tubular string to land in the first encountered seat assembly 50 to create a fluid tight barrier in the tubular string. The technique 400 next includes using the fluid tight barrier to divert fluid for purposes of performing a stimulation operation in the stage, pursuant to block 412.

If a determination is made (diamond 416) that a stimulation operation is to be performed in another stage, then a tool is run inside the tubular string is used (block 420) to place the seat assembly 50 in a pass through state to cause the object to travel to the next seat assembly 50 to create a fluid tight barrier in the tubular string in the next stage, and control returns to block 412, where the fluid diversion provided by the fluid tight barrier is used to perform a stimulation operation in the next stage.

Figure 15:
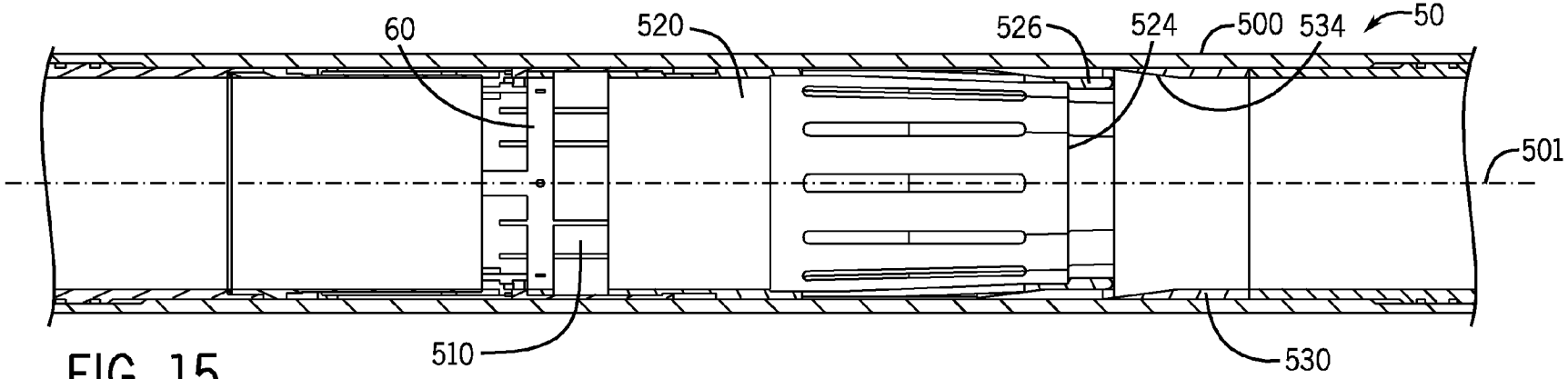
FIG. 15 is a schematic diagram of the seat assembly in its pass through state according to embodiments of the invention.

FIG. 15 generally depicts the seat assembly 50 in accordance with some exemplary, non-limiting embodiments. For this example, the seat assembly 50 includes a collet 520, which forms the seat forming element 54 (see FIG. 1, for example) of the seat assembly 50. In particular, FIG. 15 depicts the seat assembly 50 in its pass through state, a state in which an opening 524 at a lower end 526 of the collet 520 is in its radially expanded position. The opening 524 is radially contracted to place the seat assembly 50 in its object catching state (as depicted in FIG. 16) by compressing the collet 520 to restrict the opening 524.

More specifically, for this purpose, the seat assembly 50 includes an operator mandrel 510 on one end of the collet 520 and a sleeve 530 on the other end of the collet 520. In general, the sleeve 530 is fixed to an outer tubular housing 500 of the seat assembly 50, which is concentric about a longitudinal axis 501 of the assembly 50 and forms a corresponding section of the tubular string. The collet 520 longitudinally slides along the axis 501 inside the housing 500. The sleeve 530 is located, for this example, downhole of the collet 520 and is fixed to the housing 500. In general, the sleeve 530 contains an inclined, or beveled, surface 534, which is constructed to compress the lower end 526 of the collet 520 for purposes of placing the seat assembly 50 in the object catching state.

In this manner, for this example, the operator mandrel 520 contains the inner surface profile 60 and is located at the other, uphole end of the collet 520 and is constructed to, when a suitable force is applied to the operator mandrel 510 via a shifting tool, slide inside the housing 50. The downhole end of the sleeve 510 is connected to the uphole end of the collet 520 such that the collet 520 is constructed to slide inside the housing 500 with the sleeve 510. Therefore, when a shifting tool engages the profile 60 and shifts the profile 60 and therefore the sleeve 510 in a downhole direction (for this example), the lower end 526 of the collet 520 is radially compressed by the surface 534, thereby restricting the opening 524 and thereby placing the seat assembly 50 in the object catching state, which is depicted in FIG. 16.

Figure 16:
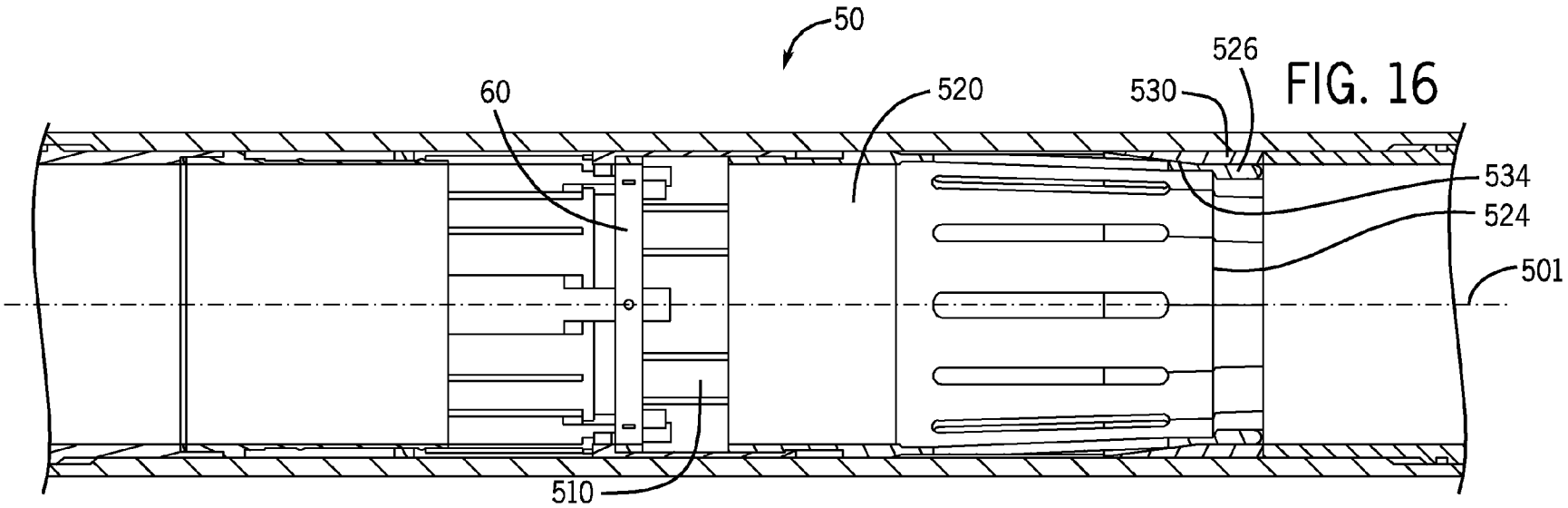
FIG. 16 is a schematic diagram of the seat assembly in its object catching state according to embodiments of the invention.
Figure 18:
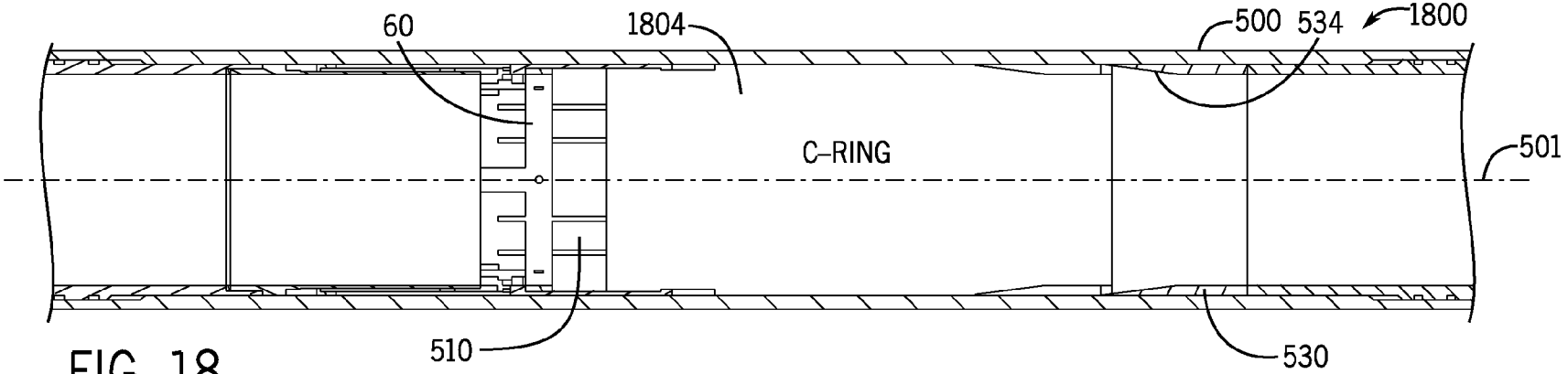
FIG. 18 is a schematic diagram of a seat assembly in its pass through state according to a further example implementation.
Figure 19:
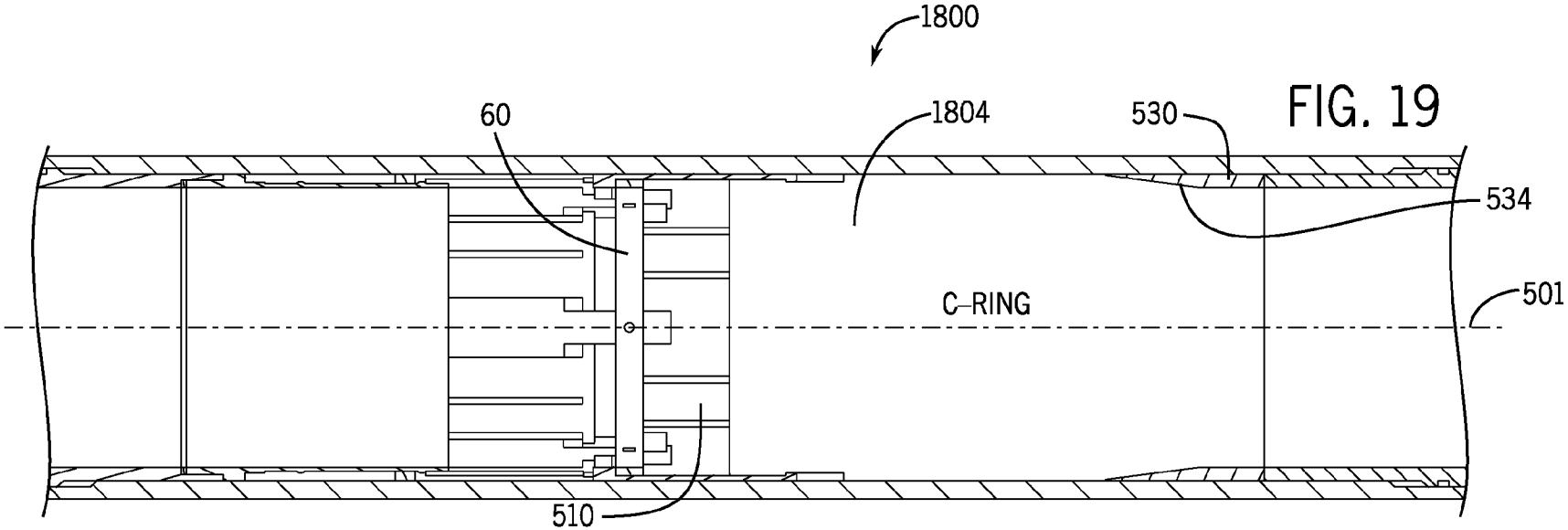
FIG. 19 is a schematic diagram of a seat assembly in its object catching state according to a further example implementation.

It is noted that FIGS. 15 and 16 merely depict an exemplary design for the seat assembly 50, with many other variations being contemplated. For example, the seat assembly 50 may be transitioned from the pass through state to the object catching state by shifting the operator mandrel 510 uphole, in accordance with other embodiments of the invention. As another variation, the collet 520 may be replaced with another compressible element, such as a C-ring, for example. For example, FIG. 18 depicts a seat assembly 1800 that has the same general design as the seat assembly 50, except that the seat assembly 1800 has a C-ring 1804 that replaces the collet 520. FIG. 18 depicts the seat assembly 1800 in its pass through state, and FIG. 19 depicts the seat assembly 1800 in its object catching state.

Note that in each embodiment described above, the seat assemblies 50 disposed along the length of the tubular string 20 may all have substantially the same opening size when in the pass through state; and similarly the seat assemblies 50 disposed along the length of the tubular string 20 may all have substantially the same opening size when in the object catching state. Thus, each dropped object (such as activation ball 90) may be approximately the same size in outer perimeter, and each dropped object 90 will pass through all of the seat assemblies 50, which are in the pass through state, and will only land in the casing seat assemblies 50, which are in the object catching state.

Other variations are contemplated and are within the scope of the appended claims. For example, in accordance with some embodiments of the invention, in lieu of or in addition to running a tool inside the tubular string to perforate the tubular string, the tubular string may be preformed with openings to allow fluid communication with the surrounding formation(s). As another variation, the tubular string may contain sleeve valves that are opened (using a shifting tool, for example) to establish or further improve fluid communication with the surrounding formation(s).

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

deploying a tubular string comprising a seat assembly in a well;

running a shifting tool in a passageway of the tubular string;

shifting the seat assembly with the shifting tool to cause the seat assembly to transition between an object pass through state in which the seat assembly forms a seat that is adapted to allow an untethered object communicated in the passageway of the tubular string to pass through the seat assembly to an object catching state in which the seat assembly is adapted to catch the object to form a fluid barrier in the tubular string; and diverting fluid in the tubular string using the fluid barrier.

2. The method of claim 1, further comprising:

using the diverting in a stimulation operation to stimulate a region of the well.

3. The method of claim 1, wherein the tubular string comprises a casing string.

4. The method of claim 1, wherein the tubular string comprises at least one packer to form an annular barrier between the tubular string and a wellbore wall.

5. The method of claim 1, wherein the running of the shifting tool in the passageway of the tubular string comprises running the shifting tool in the passageway on a wireline, a slickline or a coiled tubular string.

6. The method of claim 1, wherein the act of using the shifting tool comprises running the shifting tool in the tubular string on a perforating gun or on a tool adapted to deliver an abrasive fluid to abrade a wall of the tubular string.

7. The method of claim 1, further comprising:

after the diverting, running a shifting tool in the tubular string to shift the seat assembly to cause the assembly to transition from the object catching state to the object pass through state to allow the object to pass through the seat assembly.

8. The method of claim 1, further comprising:

after the diverting, fishing the object from the assembly.

9. A method comprising:

deploying tubular string comprising seat assemblies in a well, each of the seat assemblies having an object catching state in which the seat assembly is adapted to allow an untethered object communicated through a passageway of the tubular string to pass through the seat assembly and a pass through state in which the seat assembly is adapted to catch the object;

configuring all of the assemblies to be in the object catching state when the tubular string is initially deployed in the well;

deploying the untethered object in the tubular string to cause the object to land in a seat of one of the assemblies to create a fluid barrier in the tubular string;

diverting fluid using the fluid tight barrier to perform a stimulation operation in the well;

running a shifting tool in the tubular string in the passageway of the tubular string to shift the seat assembly having the seat in which the object has landed to cause the shifted seat assembly to release the object to allow the object to travel through the tubular string to land in a seat of another one of the seat assemblies; and repeating the acts of using the fluid tight barrier and running the shifting tool.

10. The method of claim 9, wherein the tubular string comprises a casing string.

11. The method of claim 9, wherein the tubular string comprises at least one packer to form an annular barrier between the tubular string and a wellbore wall.

12. The method of claim 9, further comprising:

perforating the tubular string at a plurality of locations associated with the seat assemblies prior to the act of deploying the object.

13. The method of claim 9, further comprising:

causing the object to automatically be released from at least one of the seats to relieve a pressure in the tubular string in response to the pressure exceeding a threshold.

14. A system usable with a well, comprising:

a tubular string to be installed in the well, the tubular string comprising a passageway; and at least one seat assembly disposed in the tubular string, said at least one assembly adapted to be shifted by a shifting tool deployed in the passageway of the tubular string after the tubular string is installed in the well to transition the seat assembly between an object pass through state in which the seat assembly forms a seat that is adapted to allow an untethered object communicated in the passageway of the tubular string to pass through the seat assembly to an object catching state in which the seat assembly is adapted to catch the object to form a fluid barrier in the tubular string.

15. The system of claim 14, wherein said at least one seat assembly comprises:

a compressible element to form the seat when compressed; and a mandrel having a profile adapted to be engaged by the shifting tool, wherein the mandrel is adapted to be shifted by the shifting tool and compress the compressible element when shifted by the shifting tool to transition the seat assembly from the object pass through state to the object catching state.

16. The system of claim 14, wherein said at least one seat assembly comprises:

a compressible element to form the seat when compressed; and a mandrel having a profile adapted to be engaged by the shifting tool, wherein the mandrel is adapted to be shifted by the shifting tool to release the compressible element from being compressed when shifted by the shifting tool to transition the seat assembly from the object catching state to the object pass through state.

17. The system of claim 14, wherein the tubular string comprises a casing string.

18. The system of claim 14, the tubular string comprises at least one packer to form an annular barrier between the tubular string and a wellbore wall.

19. The system of claim 14, further comprising an activation object to land in the seat.

20. The system of claim 19, wherein the activation object is adapted to degrade in the well to allow the activation object to pass through the seat assembly when the seat assembly is in the object catching state.

21. The system of claim 19, wherein the activation object comprises a fishing profile adapted to be engaged to retrieve the activation object from the well.

22. A system usable with a well, comprising:

a tubular string; and a plurality of seat assemblies disposed in the tubular string, each of the seat assemblies being adapted to be shifted by a shifting tool run inside a passageway of the tubular string to transition the seat assembly between a pass through state in which the seat assembly is adapted to allow an object communicated through a passageway of the tubular string to pass through the seat assembly and an object catching state in which the seat assembly is adapted to catch the object in a seat of the assembly to form a fluid barrier in the tubular string, wherein all of the assemblies are configured to be in the object catching state when the tubular string is initially deployed in the well.

23. An assembly usable with a well, comprising:

a tubular housing adapted to form part of a tubular string installed in a well;

a compressible element disposed in the housing having a compressed state in which the element is adapted to form a seat to catch an object communicated to the apparatus via the tubular string and an uncompressed state in which the element is adapted to allow the object to pass through the apparatus; and an operator comprising a profile adapted to be engaged by a shifting tool run inside the tubular string after the string is installed in the well to transition the compressible element between the compressed state and the uncompressed state.

24. The assembly of claim 23, further comprising an inclined surface, wherein the operator is adapted to force the compressible element onto the inclined surface to transition the compressible element from the uncompressed state to the compressed state in response to the shifting tool engaging the profile and moving in a predetermined direction.

25. The assembly of claim 23, wherein the compressible element comprises a collet or a C ring.

* * * * *